US006729319B2

(12) United States Patent
Mitsutani

(10) Patent No.: US 6,729,319 B2
(45) Date of Patent: May 4, 2004

(54) APPARATUS AND METHOD FOR CONTROLLING INTERNAL COMBUSTION ENGINE

(75) Inventor: Noritake Mitsutani, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 168 days.

(21) Appl. No.: 10/178,481

(22) Filed: Jun. 25, 2002

(65) Prior Publication Data

US 2003/0005915 A1 Jan. 9, 2003

(30) Foreign Application Priority Data

Jul. 6, 2001 (JP) ..... 2001-206515
Jun. 21, 2002 (JP) ..... 2002-181660

(51) Int. Cl.[7] ..... F02M 25/08; F02D 41/14

(52) U.S. Cl. ..... 123/687; 123/520; 123/674; 123/698

(58) Field of Search ..... 123/520, 674, 123/687, 698; 701/104, 109

(56) References Cited

U.S. PATENT DOCUMENTS 5,626,122 A * 5/1997 Azuma ..... 123/685
5,806,507 A * 9/1998 Osanai ..... 123/698
6,321,735 B2 * 11/2001 Grieve et al. ..... 123/674
6,675,788 B2 * 1/2004 Inoue et al. ..... 123/698

FOREIGN PATENT DOCUMENTS

JP A 11-264351 9/1999

* cited by examiner

*Primary Examiner*—Tony M. Argenbright
(74) *Attorney, Agent, or Firm*—Oliff & Berridge, PLC

(57) ABSTRACT

Gas containing fuel vapor is purged as purge gas from a canister to an intake passage through a purge line. An ECU computes purge flow rate, which is the flow rate of the purge gas, and computes vapor concentration, which is the concentration of the fuel vapor contained in the purge gas. The ECU obtains a concentration correction value in accordance with the rate of change of the computed purge flow rate. The ECU correct the computed vapor concentration by using the concentration correction value and by taking into consideration of the time at which the purge flow rate is computed and the time at which purge gas having the computed flow rate is drawn into the combustion chamber. The ECU sets the fuel supply amount in accordance with the computed purge flow rate and the corrected vapor concentration. As a result, the accuracy of the air-fuel ratio control during purging is improved.

19 Claims, 14 Drawing Sheets

APPARATUS AND METHOD FOR CONTROLLING INTERNAL COMBUSTION ENGINE

BACKGROUND OF THE INVENTION

The present invention relates to an apparatus and a method for controlling an internal combustion engine that has a fuel vapor treating apparatus, which collects fuel vapor in a fuel tank to a canister without releasing the fuel vapor into the atmosphere and purges the collected fuel vapor to the intake passage of the engine as necessary.

A typical internal combustion engine driven with volatile liquid fuel includes a fuel vapor treating apparatus. The fuel vapor treating apparatus has a canister for temporarily storing fuel vapor generated in a fuel tank. When necessary, fuel vapor collected by an adsorbent in the canister is purged to the intake passage of the engine from the canister through a purge passage, and is mixed with air drawn into the engine. The fuel vapor is combusted in the combustion chamber of the engine together with fuel injected from the injector. A purge control valve located in the purge passage adjusts the flow rate of gas (purge gas) containing fuel vapor to the intake passage.

In the above internal combustion engine, the air-fuel ratio of combustible gas mixture supplied to the combustion chamber is detected. The amount of fuel injected from the injector is controlled such that the detected actual air-fuel ratio matches with a target value.

To optimally control the air-fuel, the amount of fuel injected from the injector needs to be controlled by taking the amount of fuel vapor purged to the intake passage through the purge passage.

Typically, the amount of injected fuel is controlled in the following manner when the influence of fuel vapor is taken into consideration. First, a basic fuel injection amount (time) is computed based on parameters indicating the running state of the engine, such as the engine speed and the intake air amount. Then, a final fuel injection amount (time) is determined by adjusting the basic fuel injection amount with a air-fuel ratio feedback correction factor, an air-fuel ratio learning value, a purging air-fuel ratio correction factor, and a correction factors obtained based on the running states. The air-fuel ratio feedback correction factor corresponds the difference between the air-fuel ratio of the previous fuel injection relative to the stoichiometric air-fuel ratio. The air-fuel ratio feedback correction factor is used for permitting the air-fuel ratio in the current fuel injection to approximate the stoichiometric air-fuel ratio. The air-fuel ratio learning value is a correction factor that is learned and stored for each running state region based on the results of air-fuel ratio feedback control in different running state regions. Using the air-fuel ratio learning value improves the accuracy of the air-fuel ratio feedback control. The purge air-fuel ratio correction factor is obtained by considering the influence of the fuel vapor introduced into the intake passage to the air-fuel ratio. The purge air-fuel ratio correction factor is computed based on a purge rate and a vapor concentration learning value. The purge rate refers to a coefficient that represents the rate of the flow rate of purge gas introduced into the intake passage to the flow rate of intake air in the intake passage. The vapor concentration learning value refers to a coefficient that reflects the concentration of the vapor component in the purge gas. The product of the purge rate and the vapor concentration learning value is used as the purge air-fuel ratio correction factor for correcting the air-fuel ratio.

When the purge flow rate is abruptly changed, a response delay occurs due to the distance between the purge control valve and the combustion chamber. Accordingly, the purge flow rate is increased to a theoretical purge flow rate value, which corresponds to the actual opening degree of the purge control valve, after a delay. Thus, if the purge flow rate is abruptly changed, the actual purge rate is different from the theoretical purge rate, which corresponds to the theoretical value of the purge flow rate. Therefore, if the fuel injection amount is computed based on the theoretical purge rate, which corresponds to the theoretical purge flow rate value, the fuel injection amount would be insufficient or excessive, which causes the air-fuel ratio to be different from the stoichiometric air-fuel ratio.

To solve the above problems, Japanese Laid-Open Patent Publication No. 11-264351 discloses a controller that computes the flow rate of purge gas supplied to a combustion chamber by taking a response delay of purge flow rate due to the distance between a purge control valve and the combustion chamber. When the purge flow rate is abruptly changed, a change of the vapor concentration is estimated based on the rate of change of the purge flow rate.

When the purge flow rate is changed, the amount of fuel vapor separated from the adsorbent in a canister is changed accordingly. However, when the purge flow rate is abruptly increased, the amount of fuel vapor separated from the adsorbent is not quickly increased, which causes the separated fuel vapor to increase some time after the purge flow rate is increased. Therefore, when the purge flow rate is abruptly increased, the concentration of the fuel vapor in the purge gas is temporarily lowered. In the above mentioned publication, delay of separation of fuel vapor in the canister due to an abrupt increase of the purge flow rate is not taken into consideration. Therefore, when the purge flow rate is changed, the fuel vapor concentration cannot be accurately computed, which, in turn, causes an inaccurate computation of the fuel injection amount. The accuracy of the air-fuel ratio control is deteriorated, accordingly.

SUMMARY OF THE INVENTION

Accordingly, it is an objective of the present invention to provide an apparatus and a method for controlling an internal combustion engine that improves the accuracy of air-fuel ratio control when the purge flow rate is changed.

To achieve the foregoing and other objectives and in accordance with the purpose of the present invention, an apparatus for controlling the air-fuel ratio of air-fuel mixture drawn into a combustion chamber of an engine is provided. An intake passage of the engine is connected to a canister by a purge line. The canister adsorbs fuel vapor generated in the fuel tank and permits the adsorbed fuel vapor to be separated. Gas containing fuel vapor is purged as purge gas from the canister to the intake passage through the purge line. The apparatus includes a purge controlling device, a sensor for detecting the air-fuel ratio of the air-fuel mixture, and a computer. The purge controlling device adjusts purge flow rate, which is the flow rate of the purge gas flowing through the purge line. The computer sets the amount of fuel supplied to the combustion chamber such that the detected air-fuel seeks a target air-fuel ratio. The computer computes the purge flow rate based on the state of the purge controlling device, and computes vapor concentration, which is the concentration of the fuel vapor contained in the purge gas, based on the difference between the detected air-fuel ratio and the target air-fuel ratio. In accordance with changes of the computed purge flow rate, the computer obtains a concentration correction value for correcting the computed vapor concentration. By taking into consideration of the difference between the time at which the purge flow rate is computed and the time at which purge gas having the computed flow rate is drawn into the combustion chamber, the computer corrects the computed vapor concentration by using the concentration correction value. The computer sets the fuel supply amount in accordance with the computed purge flow rate and the corrected vapor concentration.

The present invention may also be applied to a method for controlling the air-fuel ratio of air-fuel mixture drawn into a combustion chamber of an engine. An intake passage of the engine is connected to a canister by a purge line. The canister adsorbs fuel vapor generated in the fuel tank and permits the adsorbed fuel vapor to be separated. Gas containing fuel vapor is purged as purge gas from the canister to the intake passage through the purge line. The method includes the following steps: adjusting purge flow rate, which is the flow rate of the purge gas flowing through the purge line, with a purge controlling device; detecting the air-fuel ratio of the air-fuel mixture; computing the purge flow rate based on the state of the purge controlling device; computing vapor concentration, which is the concentration of the fuel vapor contained in the purge gas, based on the difference between the detected air-fuel ratio and the target air-fuel ratio; obtaining a concentration correction value in accordance with changes of the computed purge flow rate; correcting the computed vapor concentration by using the concentration correction value and by taking into consideration of the difference between the time at which the purge flow rate is computed and the time at which purge gas having the computed flow rate is drawn into the combustion chamber; and setting the amount of fuel supplied to the combustion chamber in accordance with the computed purge flow rate and the corrected vapor concentration such that the detected air-fuel ratio seeks a target air-fuel ratio.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A controller for an internal combustion engine 8 according to one embodiment of the present invention will now be described with reference to drawings.

Figure 1:
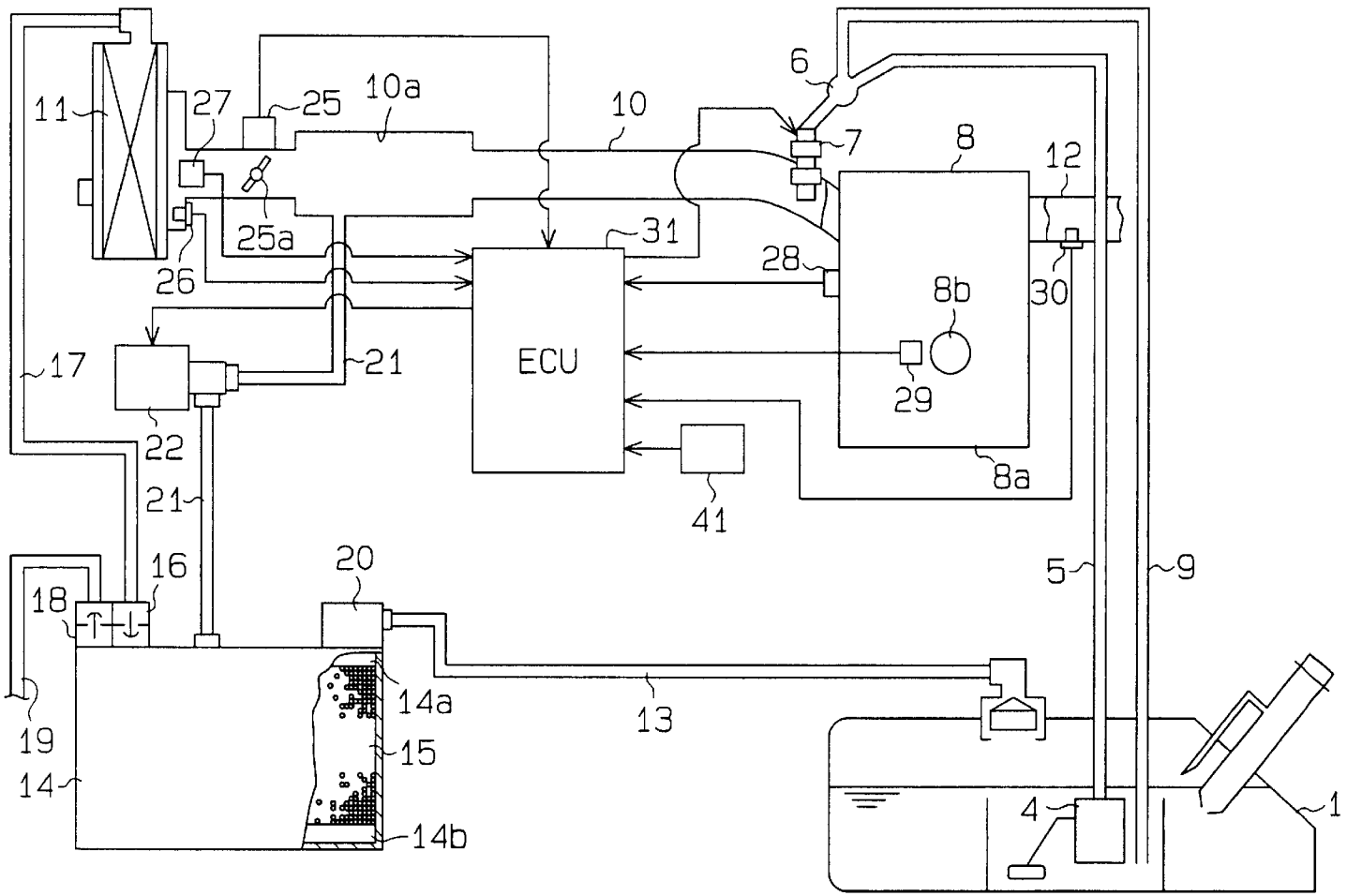
FIG. 1 is a schematic diagram illustrating an internal combustion engine system according to one embodiment of the present invention.

FIG. 1 is a schematic diagram illustrating a vehicular engine system having the fuel vapor treating apparatus according to the first embodiment. The system has a fuel tank 1 for storing fuel.

A pump 4 is located in the fuel tank 1. A main line 5 extends from the pump 4 and is connected to a delivery pipe 6. The delivery pipe 6 has injectors 7, each of which corresponds to one of the cylinders (not shown) of the engine 8. A return line extends from the delivery pipe 6 and is connected to the fuel tank 1. Fuel discharged by the pump 4 reaches the delivery pipe 6 through the main line 5 and is then distributed to each injector 7. Each injector 7 is controlled by an electronic control unit (ECU) 31 and injects fuel into the corresponding cylinder of the engine 8.

An air cleaner 11 and a surge tank 10*a* are located in an intake passage 10 of the engine 8. Air that is cleaned by the air cleaner is drawn into the intake passage 10. Fuel injected from each injector 7 is mixed with the cleaned air. The mixture is supplied to the corresponding cylinder of the engine 8 and combusted. Some of the fuel in the delivery pipe 6 is not supplied to the injectors 7 and is returned to the fuel tank 1 through the return line 9. After combustion, exhaust gas is discharged to the outside from the cylinders of the engine 8 through an exhaust passage 12.

The fuel vapor treating apparatus collects fuel vapor generated in the fuel tank 1 without emitting the fuel vapor into atmosphere. The treating apparatus has a canister 14 for collecting fuel vapor generated in the fuel tank 1 through a vapor line 13. Adsorbent 15 such as activated carbon fills part of the canister 14. Spaces 14*a*, 14*b* are defined above and below the absorbent 15, respectively.

A first atmosphere valve 16 is attached to the canister 14. The first atmosphere valve 16 is a check valve. When the pressure in the canister 14 is lower than the atmospheric pressure, the first atmosphere valve 16 is opened to permit the outside air to flow into the canister 14 and prohibits a gas flow in the reverse direction. Therefore, outside air that is cleaned by the air cleaner 11 is drawn into the canister 14. A second atmosphere valve 18 is located in the canister 14. The second atmosphere valve 18 is also a check valve. When the pressure in the canister 14 is higher than the atmospheric pressure, the second atmosphere valve 18 is opened and permits air to flow from the canister 14 to an outlet pipe 19 and prohibits airflow in the reverse direction.

A vapor control valve 20 is attached to the canister 14. The vapor control valve 20 controls fuel vapor that flows from the fuel tank 1 to the canister 14. The control valve 20 is opened based on the difference between the pressure in a zone that includes the interior of the fuel tank 1 and the vapor line 13 and the pressure in the canister 14. When opened, the control valve 20 permits vapor to flow into the canister 14.

A purge line 21 extends from the canister 14 and is connected to the surge tank 10*a*. The canister 14 collects only fuel component in the gas supplied to the canister 14 through the vapor line 13 by adsorbing the fuel component with the adsorbent 15. The canister 14 discharges the gas of which fuel component is deprived to the outside through the outlet pipe 19 when the atmosphere valve 18 is opened. When the engine 8 is running, an intake negative pressure created in the intake passage 10 is applied to the purge line 21. If a purge control valve 22, which is located in the purge line 21, is opened, in this state, fuel vapor collected by the canister 14 and fuel that is introduced into the canister 14 from the fuel tank 1 but is not adsorbed by the adsorbent 15 are purged to the intake passage 10 through the purge line 21. The purge control valve 22 is an electromagnetic valve, which moves a valve body in accordance with supplied electric current. The opening degree of the purge control valve 22 is duty controlled by the ECU 31. Accordingly, the flow rate of purge gas containing fuel vapor through the vapor line 21 is adjusted according to the running state of the engine 8.

The running state of the engine 8 is detected by various sensors. A throttle sensor 25 is located in the vicinity of a throttle 25*a* in the intake passage 10. The throttle sensor 25 detects a throttle opening degree TA, which corresponds to the degree of depression of a gas pedal, and outputs a signal representing the opening degree TA. An intake air temperature sensor 26 is located in the vicinity of the air cleaner 11. The intake air temperature sensor 26 detects the temperature of air drawn into the intake passage 10, or intake temperature THA, and outputs a signal representing the temperature THA. An intake air amount sensor 27 is also located in the vicinity of the air cleaner 11. The intake air amount sensor 27 detects the amount of air drawn into the intake passage 10, or the intake amount Q, and outputs a signal representing the intake amount Q. A coolant temperature sensor 28 is located in the engine 8. The coolant temperature sensor 28 detects the temperature of coolant flowing through an engine block 8*a*, or the coolant temperature THW, and outputs a signal representing the coolant temperature THW. A crank angle sensor (rotation speed sensor) 29 is located in the engine 8. The crank angle sensor 29 detects rotation speed of a crankshaft 8*b* of the engine 8, or the engine speed NE, and outputs a signal that represents the engine speed NE. An oxygen sensor 30 is located in the exhaust passage 12. The oxygen sensor 30 detects the concentration of oxygen in exhaust gas flowing through the exhaust passage and outputs a signal representing the oxygen concentration.

The ECU 31 receives signals from the sensors 25–30. The ECU 31 also executes air-fuel ratio control for controlling the amount of fuel injected by the injectors 7 such that the air-fuel ratio of the air-fuel mixture in the engine 8 matches a target air-fuel ratio, which is suitable for the running state of the engine 8.

The ECU 31 also controls the purge control valve 22 to adjust the purge flow rate to value that is suitable for the running state of the engine 8. That is, the ECU 31 determines the running state of the engine 8 based on the signals from the sensors 25–30. Based on the determined running state, the ECU 31 duty controls the purge control valve 22. Fuel vapor that is purged from the canister 14 to the intake passage 10 influences the air-fuel ratio of the air-fuel mixture in the engine 8. Therefore, the ECU 31 determines the opening degree of the purge control valve 22 in accordance with the running state of the engine 8.

While the purging process is being executed, the ECU 31 learns the concentration of fuel vapor in purge gas (vapor concentration) based on the result of the air-fuel ratio control and the oxygen concentration detected by the oxygen sensor 30. When the air-fuel ratio is lowered, or when the air-fuel mixture is rich, the concentration of CO in the exhaust gas of the engine 8 is increased and the oxygen concentration is decreased. Thus, the ECU 31 learns a vapor concentration value FGPG based on the oxygen concentration in the exhaust gas, which is detected by the oxygen sensor 30. In other words, the ECU 31 computes the vapor concentration value FGPG based on the difference between the target air-fuel ratio and the detected air-fuel ratio. The ECU 31 determines a duty ratio DPG based on the vapor concentration value FGPG. The duty ratio DPG corresponds to the opening degree of the purge control valve 22. The ECU 31 sends a driving pulse signal that corresponds to the duty ratio DPG to the purge control valve 22.

Basically, the ECU 31 adjusts a basic fuel injection amount (time) TP, which is previously determined based on the running state of the engine 8. Specifically, the ECU 31 adjusts the basic fuel injection amount TP based on the vapor concentration learning value FGPG, an air-fuel ratio feedback correction factor FAF, which is computed in air-fuel ratio feedback control, thereby determining a final target fuel injection amount (time) TAU.

Figure 2:
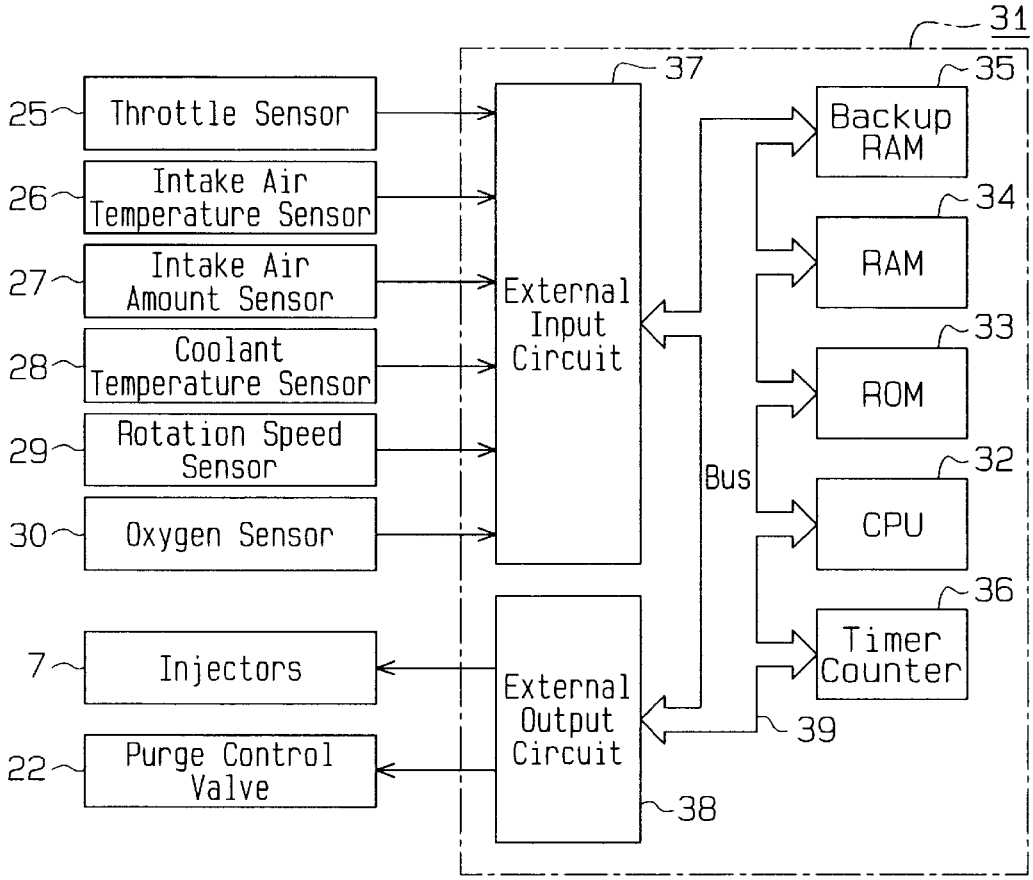
FIG. 2 is a block diagram showing an electrical construction of the electronic control unit (ECU) of the engine system shown in FIG. 1.

As shown in the block diagram of FIG. 2, the ECU 31 includes a central processing unit (CPU) 32, a read only memory (ROM) 33, a random access memory (RAM) 34, a backup RAM 35, and a timer counter 36. The devices 32–36 are connected to an external input circuit 37 and an external output circuit 38 by a bus 39 to form a logic circuit. The ROM 33 previously stores predetermined control programs used for the air-fuel ratio control and purge control. The RAM 34 temporarily stores computation results of the CPU 32. The backup RAM 35 is a battery-protected non-volatile RAM and stores data even if the ECU 31 is not activated. The timer counter 36 simultaneously is capable of performing several time measuring operations. The external input circuit 37 includes a buffer, a waveform shaping circuit, a hard filter (a circuit having a resistor and a capacitor), and an analog-to-digital converter. The external output circuit 38 includes a driver circuit. The sensors 25–30 are connected to the external input circuit 37. The injectors 7 and the purge control valve 22 are connected to the external output circuit 38.

The CPU 32 receives signals from the sensors 25–30 through the external input circuit 37. The CPU 32 executes the air-fuel ratio feedback control, the air-fuel ratio learning process, the purge control, the vapor concentration learning process, and the fuel injection control.

Figure 3:
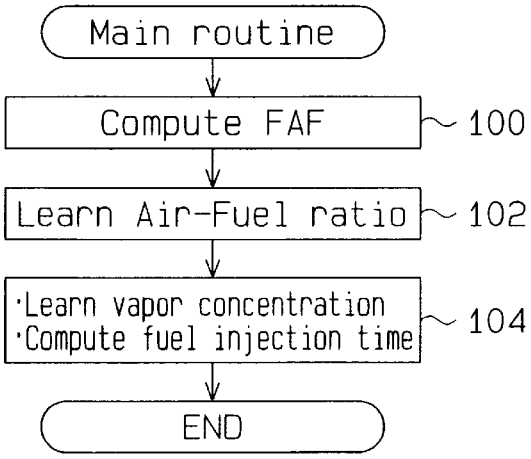
FIG. 3 is a flowchart showing a main routine of a method for controlling air-fuel ratio executed by the electronic control unit shown FIG. 2.

FIG. 3 is a flowchart showing the main routine of the air-fuel ratio control procedure executed by the ECU 31. The ECU 31 executes the main routine at a predetermined interval. When executing the main routine, the ECU 31 computes the feedback correction factor FAF in step 100. The air-fuel ratio is controlled based on the feedback correction factor FAF. In subsequent step 102, the ECU 31 learns the air fuel ratio. Then, in step 104, the ECU 31 learns the vapor concentration and/or computes the fuel injection time.

Figure 4:
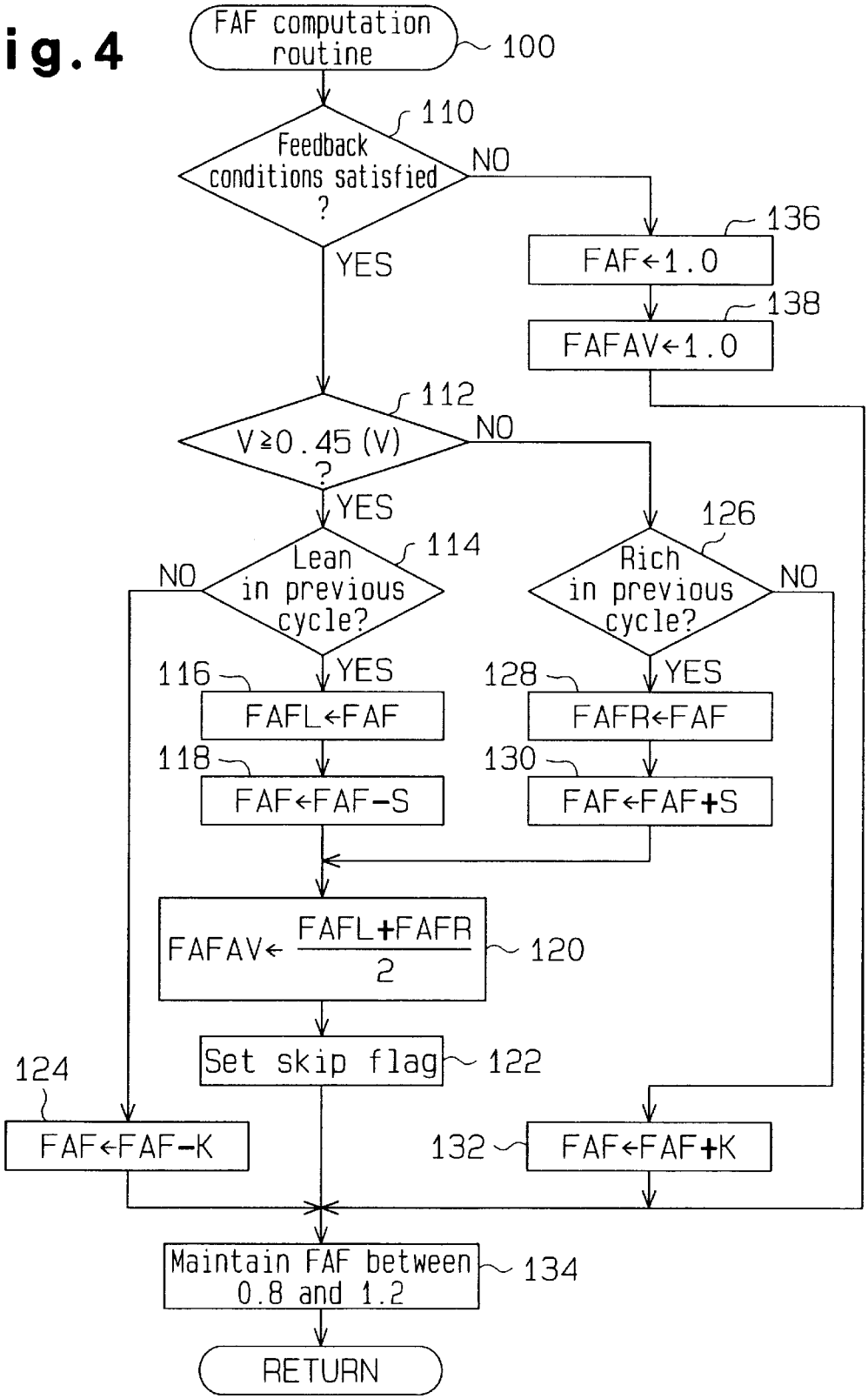
FIG. 4 is a flowchart showing a routine for computing a feedback correction factor FAF in the routine shown in FIG. 3.

Hereinafter, process of steps 100, 102, 104 will be described. First, FIG. 4 is a flowchart showing the routine for computing the feedback correction factor FAF executed in step 100 of FIG. 3. As shown in FIG. 4, the ECU 31 determines whether a feedback control condition is satisfied in step 110. If the feedback control condition is not satisfied, the ECU 31 proceeds to step 136 and fixes the feedback correction factor FAF to 1.0. Then, the ECU 31 proceeds to step 138 and fixes an average value FAFAV of the feed back correction factor FAF to 1.0. Thereafter, the ECU 31 proceeds to step 134. The average value FAFAV will be discussed below.

In step 112, the ECU 31 judges whether the output voltage V of the oxygen sensor 30 is equal to or higher than 0.45(V), or whether the air-fuel ratio of the air-fuel mixture is equal to or less than a target air-fuel ratio (for example, stoichiometric air-fuel ratio). Hereinafter, a state when the air-fuel ratio is less than the target air-fuel ratio will be described by an expression "the air-fuel mixture is rich". A state when the air-fuel ratio is higher than the target air-fuel ratio will be described by an expression "the air fuel ratio is lean". If the output voltage V is equal to or higher than 0.45(V) ($V \geqq 0.45$ (V)), that is, if the mixture is rich, the ECU 31 proceeds to step 114 and judges whether the air-fuel mixture was lean in the previous cycle. If the mixture was lean in the previous cycle, that is, if the mixture has become rich after being lean, the ECU 31 proceeds to step 116 and maintains the current feedback correction factor FAF as FAFL. After step 116, the ECU 31 proceeds to step 118. In step 118, the ECU 31 subtracts a predetermined skip value S from the current feedback correction factor FAF, and sets the subtraction result as a new feedback correction factor FAF. Therefore, the feedback correction factor FAF is quickly decreased by the skip value S.

If the ECU 31 judges that the output voltage V is less than 0.45(V) ($V<0.45$(V)) in step 112, that is, if the air-fuel mixture is lean, the ECU 31 proceeds to step 126. In step 126, the ECU 31 judges whether the air-fuel mixture was rich in the previous cycle. If the mixture was rich in the previous cycle, that is, if the mixture has become lean after being rich, the ECU 31 proceeds to step 128 and maintains the current feedback correction factor FAF as FAFR. After step 128, the ECU 31 proceeds to step 130. In step 130, the ECU 31 adds the skip value S to the current feedback correction factor FAF, and sets the addition result as a new feedback correction factor FAF. Therefore, the feedback correction factor FAF is quickly increased by the skip value S.

When proceeding to step 120 from step 118 or step 130, the ECU 31 divides the sum of the FAFL and FAFR by two and sets the division result as the average value FAFAV. That is, the average value FAFV represents the average value of the changing feedback correction factor FAF. In step S122, the ECU 31 sets a skip flag, and then proceeds to step 134.

When judging that the mixture was rich in the previous cycle in step 114, the ECU 31 proceeds to step 124. In step 124, the ECU 31 subtracts an integration value K ($K<<S$) from the current feedback correction factor FAF and proceeds to step 134. Thus, the feedback correction factor FAF is gradually decreased. When judging that the mixture was lean in the previous cycle in step 126, the ECU 31 proceeds to step 132. In step 132, the ECU 31 adds the integration value K ($K<<S$) to the current feedback correction factor FAF, and then proceeds to step 134. Thus, the feedback correction factor FAF is gradually increased.

In step 134, the ECU 31 controls the feedback correction factor FAF to be within a range between an upper limit value 1.2 and a lower limit value 0.8. That is, if the feedback correction factor FAF is within the range between 1.2 and 0.8, the ECU 31 uses the feedback correction factor FAF without changing. However, if the feedback correction factor FAF is greater than 1.2, the ECU 31 sets the feedback correction factor FAF to 1.2, and if the feedback correction factor FAF is less than 0.8, the ECU 31 sets the feedback correction factor FAF to 0.8. After step 134, the ECU 31 finishes the feedback correction factor FAF computation routine.

Figure 5:
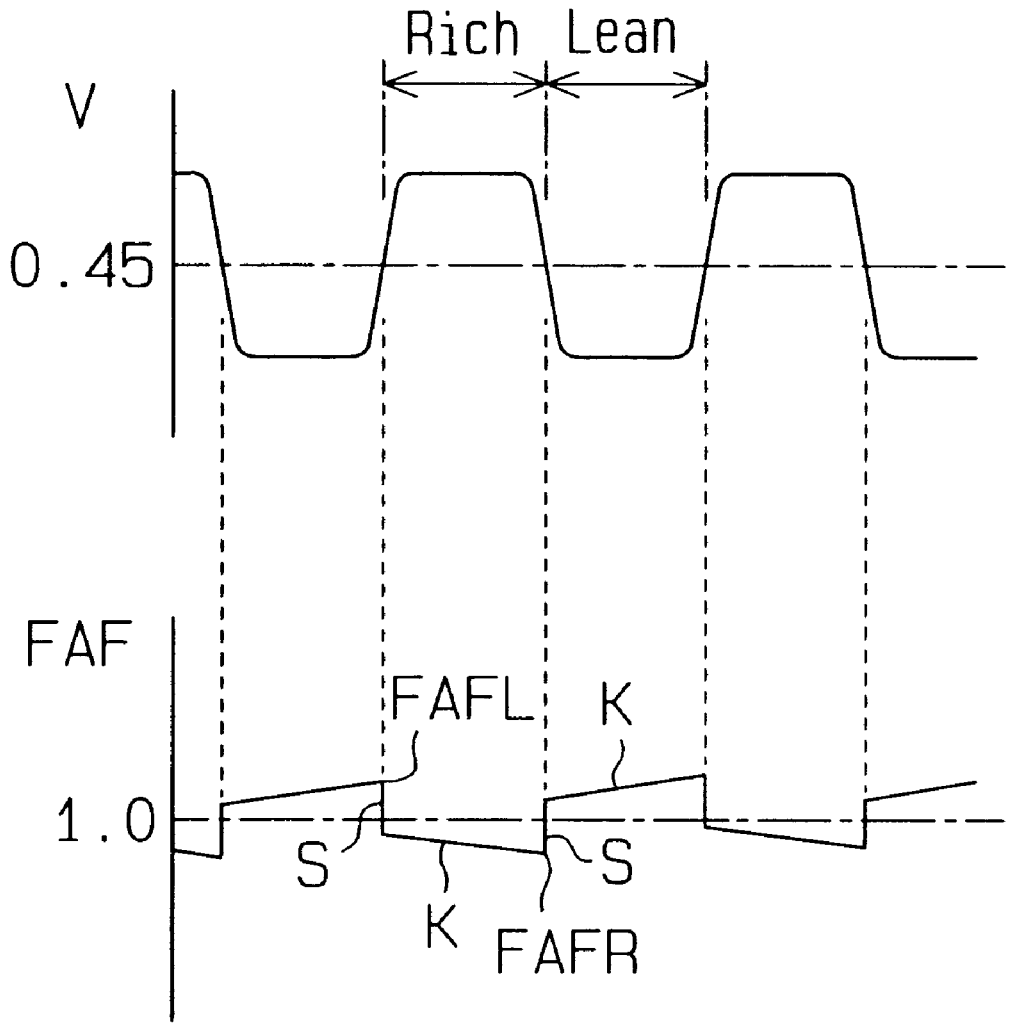
FIG. 5 is a time chart showing changes in the air-fuel ratio and changes in the air-fuel ratio feedback correction factor.

FIG. 5 is a graph showing the relationship between the output voltage V of the oxygen sensor 30 and the feedback correction factor FAF when the air-fuel ratio is maintained at the target air-fuel ratio. As shown in FIG. 5, when the output voltage V of the oxygen sensor 30 changes from a value that is less than a reference voltage, for example, 0.45 (V), to a value that is greater than the reference voltage, or when the air-fuel mixture becomes rich after being lean, the feedback correction factor FAF is quickly lowered by the skip value S and then gradually decreased by the integration value K. When the output voltage V changes from a value that is greater than the reference value to a value that is less than the reference value, or when the air-fuel mixture becomes lean after being rich, the feedback correction factor FAF is quickly increased by the skip value S and then gradually increased by the integration value K.

The fuel injection amount decreases when the feedback correction factor FAF is decreased, and increases when the feedback correction factor FAF is increased. Since the feedback correction factor FAF is decreased when the air-fuel mixture becomes rich, the fuel injection amount is decreased. Since the feedback correction factor FAF is increased when the air-fuel mixture becomes lean, the fuel injection amount is increased. As a result, the air-fuel ratio is controlled to proximate the target air-fuel ratio (stoichiometric air-fuel ratio). As shown in FIG. 5, the feedback correction factor FAF fluctuates in a range about the reference value, or 1.0.

In FIG. 5, the value FAFL represents the feedback correction factor FAF when the air-fuel mixture becomes rich after being lean. The value FAFR represents the feedback correction factor FAF when the air-fuel mixture becomes lean after being rich.

Figure 6:
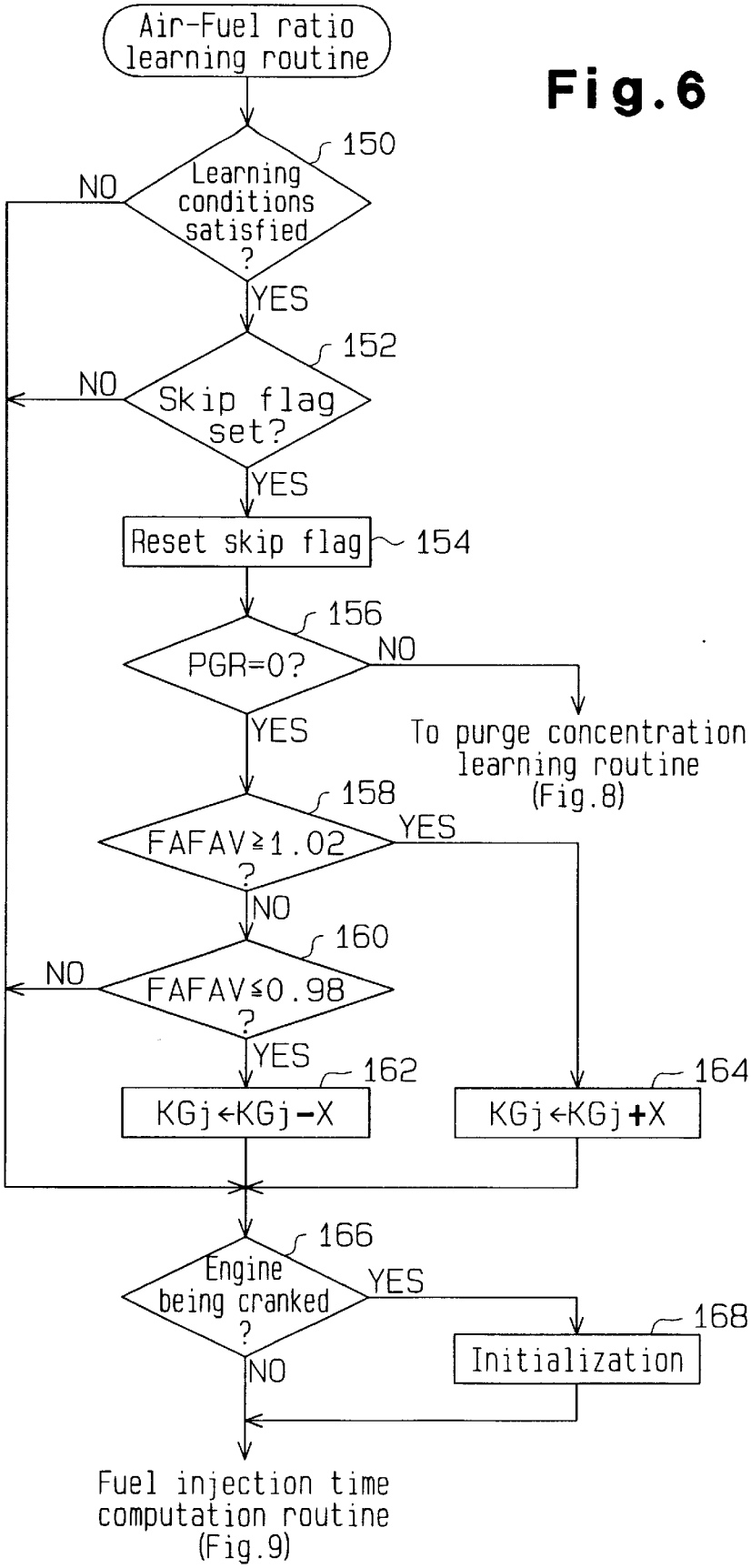
FIG. 6 is a flow chart showing a routine for learning the air-fuel ratio of the routine shown in FIG. 3.

FIG. 6 is a flowchart showing the air-fuel ratio learning routine, which is executed in step 102 of FIG. 3. In step 150 of the flowchart of FIG. 6, the ECU 31 judges whether learning condition of the air-fuel ratio is satisfied. If the condition is not satisfied, the ECU 31 jumps to step 166. If the condition is satisfied, the ECU 31 proceeds to step 152. In step 152, the ECU 31 judges whether the skip flag is set (see step 122 in FIG. 4). If the skip flag is not set, the ECU 31 jumps to step 166. If the skip flat is set, the ECU 31 proceeds to step 154 and resets the skip flag. The ECU 31 then proceeds to step 156. That is, if the skip value S is subtracted from the feedback correction factor FAF in step 118 of FIG. 5 or if the skip value S is added to the feedback correction factor FAF in step 130 of FIG. 5, the ECU 31 proceeds to step 156. Hereinafter, when the feedback correction factor FAF is abruptly changed by the skip value S, the change is described by an expression "the feedback correction factor FAF is skipped".

In step 156, the ECU 31 judges whether a purge rate PGR is zero. In other words, the ECU 31 judges whether the fuel vapor is being purged (whether the purge control valve 22 is open). The purge rate PGR refers to the rate of the flow rate of purge gas to the flow rate of intake air flowing in the intake passage 10. If the purge rate PGR is not zero, that is, if the fuel vapor is being purged, the ECU 31 proceeds to a vapor concentration learning routine shown in FIG. 8. If the purge rate PGR is zero, or if the fuel vapor is not being purged, the ECU 31 proceeds to step 158 and learns the air-fuel ratio.

In step 158, the ECU 31 judges whether the average value FAFAV of the feedback correction factor FAF is equal to or greater than 1.02. If the average value FAFAV is equal to or greater than 1.02 (FAFV≧1.02), the ECU 31 proceeds to step 164. In step 164, the ECU 31 adds a predetermined fixed value X to a current learning value KGj of the air-fuel ratio. Several learning areas j are defined in the RAM 34 of the ECU 31. Each learning area j corresponds to one of different engine load regions and stores a learning value KGj. Each learning value KGj corresponds to a different air-fuel ratio. Therefore, in step 164, the learning value KGj in a learning area j that corresponds to the current engine load is renewed.

If the average value FAFAV is determined to be less than 1.02 in step 158 (FAFAF<1.02), the ECU 31 proceeds to step 160. In step 160, the ECU 31 judges whether the average value FAFAV is equal to or less than 0.98. If the average value FAFAV is equal to or less than 0.98 (FAFAV≦0.98), the ECU proceeds to step 162. In step 162, the ECU 31 subtracts the fixed value X from the learning value KGj stored in one of the learning areas j that corresponds to the current engine load. If the average value FAFAV is greater than 0.98 (FAFAV>0.98) in step 160, that is, if the average value FAFAV is between 0.98 and 1.02, the ECU 31 jumps to step 166 without renewing the learning value KGj of the air-fuel ratio.

In step 166, the ECU 31 judges whether the engine 8 is being cranked. If the engine 8 is being cranked, the ECU 31 proceeds to step 168. In step 168, the ECU 31 executes an initiation process. Specifically, the ECU 31 sets a vapor concentration value FGPG to zero and clears a purging time count value CPGR. The ECU 31 then proceeds to a fuel injection time computation routine shown in FIG. 9. If the engine 8 is not being cranked in step 166, the ECU 31 directly proceeds to the fuel injection time computation routine shown in FIG. 9.

Figure 8:
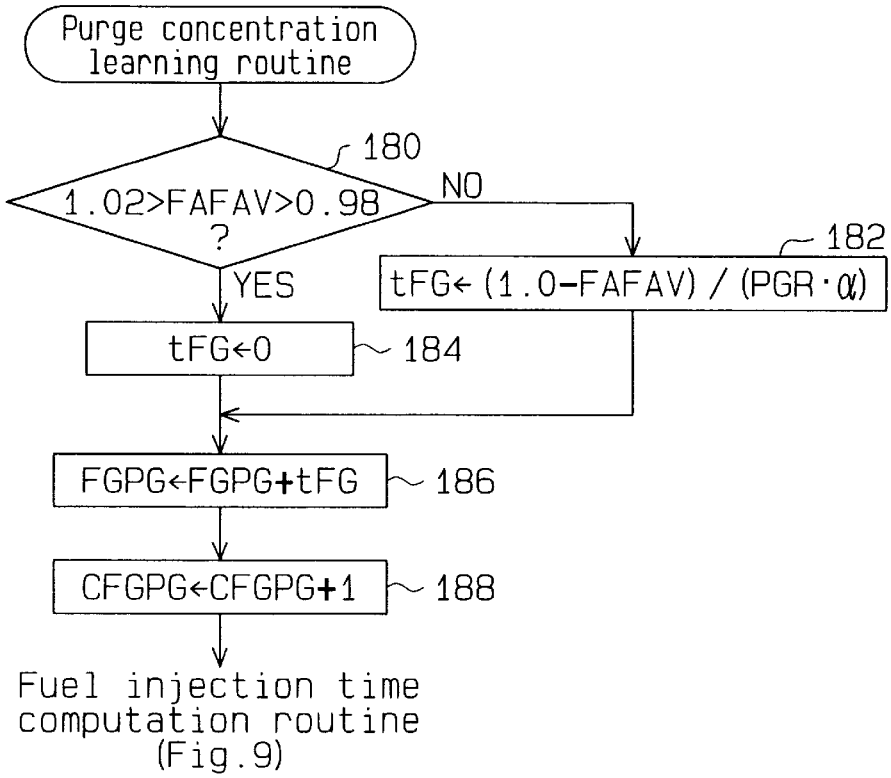
FIG. 8 is a flowchart showing the routine for learning the vapor concentration in the routine shown in FIG. 3.
Figure 9:
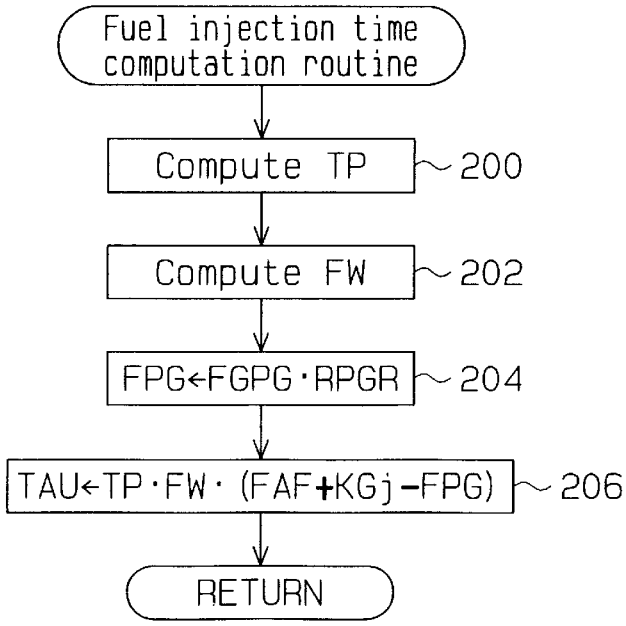
FIG. 9 is a flowchart showing a routine for computing a time of fuel injection in the routine shown in FIG. 3.

FIG. 8 is a flowchart showing the vapor concentration learning routine, which is executed in step 104 of FIG. 3. FIG. 9 is a flowchart showing the fuel injection time computation routine executed in step 104 of FIG. 3.

Figure 7:
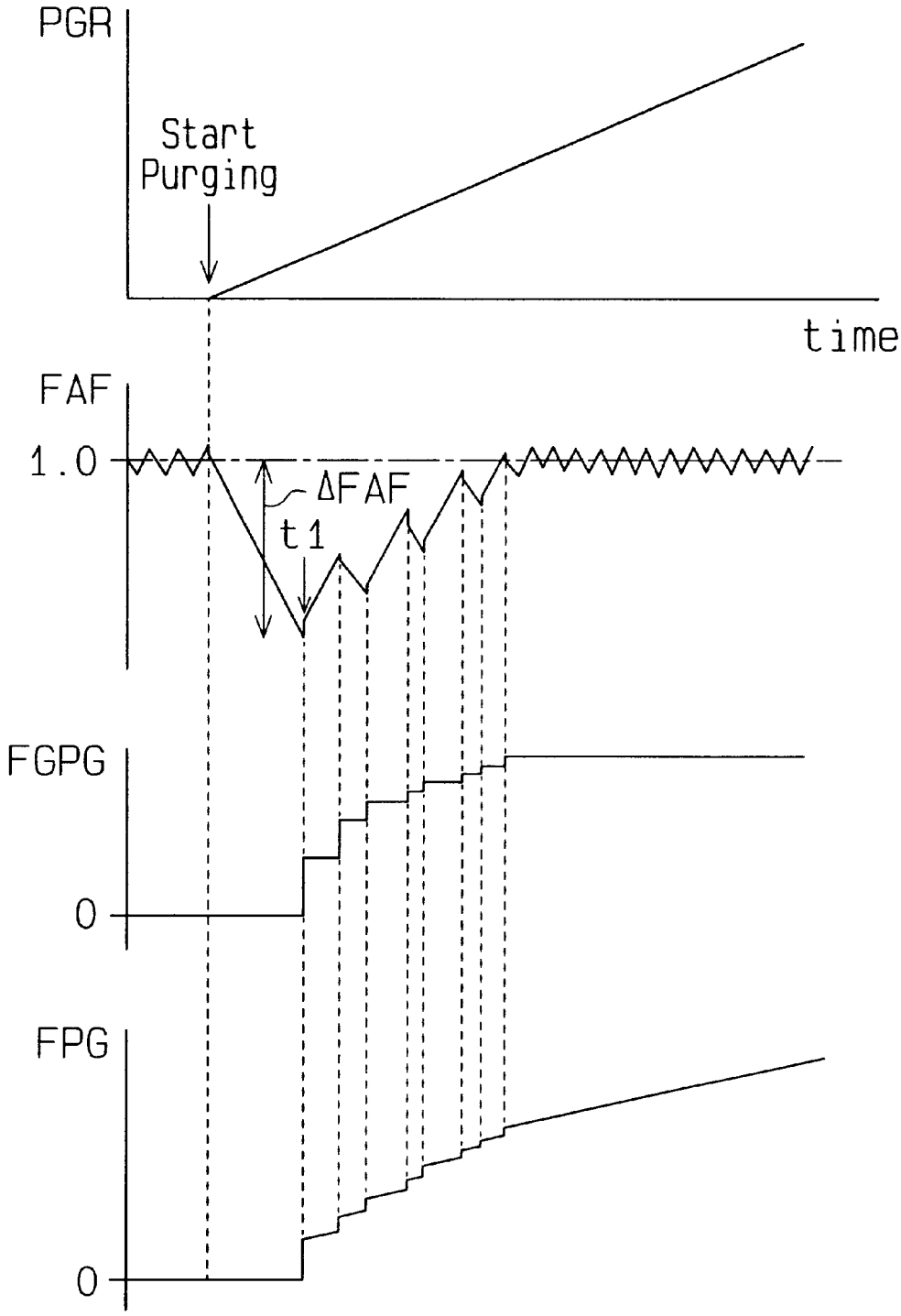
FIG. 7 is graph for explaining the theory of learning of vapor concentration.

Prior to the description of the vapor concentration learning routine of FIG. 8, the concept of the vapor concentration learning will be explained referring to the graph of FIG. 7. Learning of the vapor concentration is initiated with accurately obtaining the vapor concentration. FIG. 7 illustrates the learning process of the vapor concentration value FGPG. A purge air-fuel ratio correction factor (hereinafter referred to as purge A/F correction factor) FPG reflects the amount of fuel vapor drawn into the combustion chamber and is computed by multiplying the vapor concentration value FGPG with the purge rate PGR. The vapor concentration value FGPG is computed by the following equations 1, 2 every time the feedback correction factor FAF is changed by the skip value S (see steps 118 and 130 of FIG. 4).

$$tFG \leftarrow (1-FAFAV)/(PGR \cdot \alpha) \quad \text{Equation 1}$$

$$FGPG \leftarrow FGPG + tFG \quad \text{Equation 2}$$

As described in step 120 of FIG. 4, the value FAFAV represents the average value of the feedback correction factor FAF. The value $\alpha$ is a predetermined constant. In this embodiment, the value $\alpha$ is set to two. Based on the average value FAFAV and the purge rate PGR, the renew amount tFG of the vapor concentration value FGPG is computed. Then, every time the feedback correction factor FAF is changed by the skip value S, the computed renew amount tFG is added to the vapor concentration value FGPG.

Since the air-fuel mixture becomes rich as shown in FIG. 7 when the purging is started, the feedback correction factor FAF is decreased so that the actual air-fuel ratio seeks the stoichiometric air-fuel ratio. When the air-fuel mixture is judged to have become lean after being rich based on the detection result of the oxygen sensor 30 at time t1, the feedback correction factor FAF is increased. The change amount of the feedback correction factor FAF from when the purging is started to time t1 is represented by ΔFAF. The change amount ΔFAF represents the amount of change in the air-fuel ratio due to the purging. The change amount ΔFAF also represents the vapor concentration at time t1.

After time t1, the air-fuel ratio is maintained at the stoichiometric air-fuel ratio. Thereafter, to put average value FAFAV of the feedback correction factor FAF to 1.0 while maintaining the air-fuel ratio to the stoichiometric air-fuel ratio, the vapor concentration value FGPG is gradually renewed every time the feedback correction factor FAF is changed by the skip value S. As shown by the above equation 1, the renew amount tFG for a single renewal of the vapor concentration value FGPG is represented by (1−FAFAV)/(PGR·2).

After the vapor concentration value FGPG is renewed for several times, the average value FAVAV of the feedback correction factor FAF returns to 1.0. Thereafter, the vapor concentration value FGPG is constant. This means that the vapor concentration value FGPG accurately represents the actual vapor concentration and, in other words, that the learning of the vapor concentration is completed.

The actual amount of fuel vapor drawn into the combustion chamber reflects a value that is obtained by multiplying the vapor concentration value FGPG with the actual purge rate RPGR. Therefore, the purge A/F correction factor FPG (FPG=FGPG·RPGR), which reflects the actual amount of the fuel vapor, is renewed every time the vapor concentration value FGPG is renewed as shown in FIG. 7. The purge A/F correction factor FPG is therefore increased as the actual purge rate RPGR is increased.

Even if the learning of the vapor concentration is completed after the purging is started, the feedback correction factor FAF is displaced from 1.0 if the vapor concentration is changed. At this time, the renew amount tFG of the vapor concentration value FGPG is computed by using the equation 1.

The vapor concentration learning routine shown in FIG. 8 will now be described. The routine of FIG. 8 is started when the ECU 31 judges that the purging is being executed in step 156 of FIG. 6. In step 180, the ECU 31 judges whether the average value FAFAV of the feedback correction factor FAF is within a predetermined range. That is, the ECU 31 judges whether the inequality 1.02>FAFAV>0.98 is satisfied. If the inequality 1.02>FAFAV>0.98 is satisfied, the ECU 31 proceeds to step 184. In step 184, the ECU 31 sets the renew amount tFG to zero and proceeds to step 186. In this case, the vapor concentration value FGPG is not renewed.

If an inequality FAFAV≧1.02 or an inequality FAFAV≦0.98 is satisfied in step 180, the ECU 31 proceeds to step 182. In step 182, the ECU 31 computes the renew amount tFG based on the equation 1.

As described above, the value α is two. That is, when the average value FAFV of the feedback correction factor exits the range between 0.98 and 1.02, the renew amount tFG is set to the half of the displacement of FAFV from 1.0. The ECU 31 then proceeds to step 186. In step 186, the ECU 31 adds the renew amount tFG to the vapor concentration value FGPG. In step 188, the ECU 31 increments a renew counter CFGPG by one. The renew counter CFGPG represents the number of times the vapor concentration value FGPG has been renewed. The ECU 31 then proceeds to a fuel injection time computation routine shown in FIG. 9.

Next, the fuel injection time computation routine of FIG. 9 will be described. In step 200, the ECU 31 computes a basic fuel injection time TP based on an engine load Q/N and an engine speed NE. The basic fuel injection time TP is a value obtained through experiments and previously stored in the ROM 33. The basic fuel injection time TP is designed to match the air-fuel ratio with a target air-fuel ratio, and is a function of the engine load Q/N (the intake air amount Q/the engine speed NE) and the engine speed NE.

Then, in step 202, the ECU 31 computes a correction factor FW. The correction factor FW is used for increasing the fuel injection amount when the engine 8 is being warmed or when the vehicle is accelerated. When there is no need for a correction to increase the fuel injection amount, the correction factor FW is set to 1.0.

In step 204, the ECU 31 multiplies the vapor concentration value FGPG by the actual purge rate RPGR to obtain the purge A/F correction factor FPG. The purge A/F correction factor FPG is set to zero from when the engine 8 is started to when the purge is started. After the purging is started, the purge A/F correction factor FPG is increased as the fuel vapor concentration is increased. If the purging is temporarily stopped while the engine 8 is running, the purge A/F correction factor FPG is set at zero as long as the purging is not started again.

Thereafter, the ECU 31 computes the fuel injection time TAU according to the following equation 3 in step 206. The ECU 31 thus completes the fuel injection time computation routine.

$$TAU \leftarrow TP \cdot FW \cdot (FAF + KGJ - FPG) \qquad \text{Equation 3}$$

As described above, the feedback correction factor FAF is used for controlling the air-fuel ratio to match with a target air-fuel ratio based on signals from the oxygen sensor 30. The target air-fuel ratio may have any value. In this embodiment, the target air-fuel ratio is set to the stoichiometric air-fuel ratio. In the following description, a case where the target air-fuel ratio is set to the stoichiometric air-fuel ratio will be discussed. When the air-fuel ratio is too low, that is, when the air-fuel mixture is too rich, the oxygen sensor 30 outputs voltage about 0.9(V). When the air-fuel ratio is too high, that is, when the air-fuel mixture is too lean, the oxygen sensor 30 outputs voltage about 0.1(V).

Figure 10:
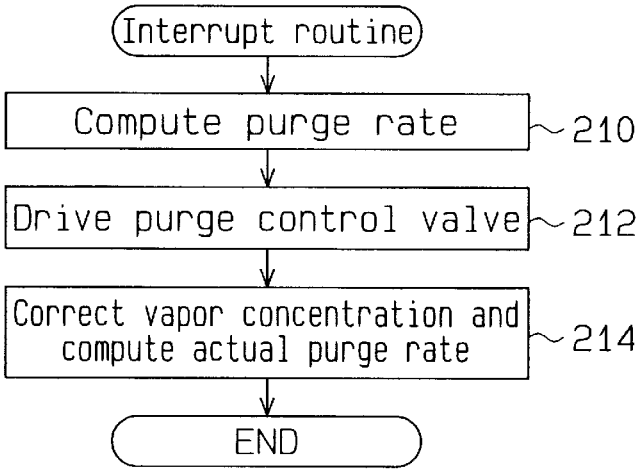
FIG. 10 is an interrupt routine executed by the ECU shown in FIG. 2.

FIG. 10 is a flowchart showing an interrupt routine that is handled during the main routine of FIG. 3. The interrupt routine of FIG. 10 is handled at a predetermined computation cycle for computing the duty ratio DPG of the driving pulse signal sent to the purge control valve 22. When handling the routine of FIG. 10, the ECU 31 first computes the purge rate in step 210. Then, in step 212, the ECU 31 executes a procedure for driving the purge control valve 22. In step 214, the ECU 31 executes a procedure for correcting the vapor concentration and a procedure for computing the actual purge rate.

Figure 11:
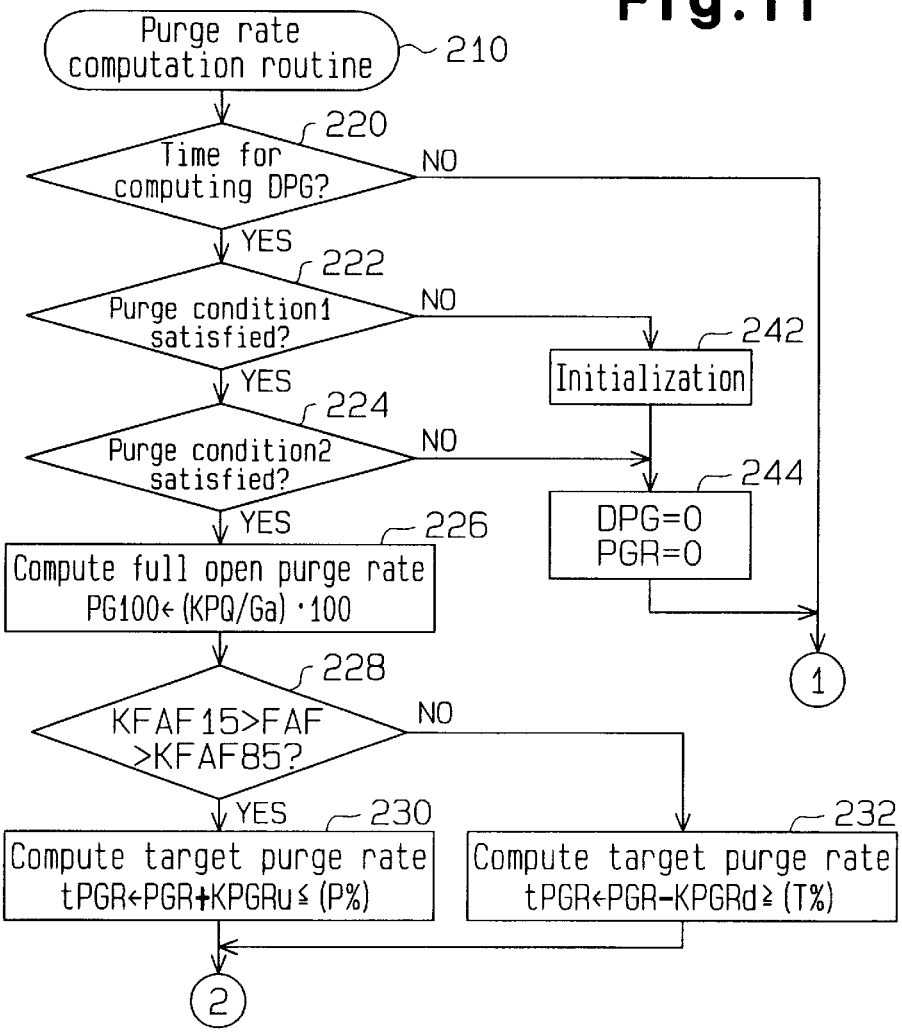
FIG. 11 is a flowchart showing a first part of a routine for computing a purge rate shown in FIG. 10.
Figure 12:
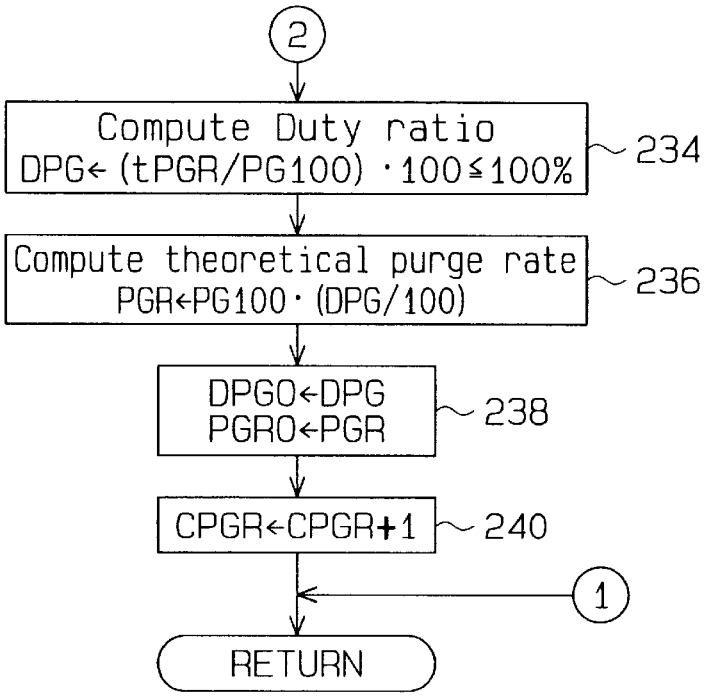
FIG. 12 is a flowchart showing a second part of the routine shown in FIG. 11.

Procedures executed in steps 210, 212, 214 of FIG. 10 will be described below. FIGS. 11 and 12 are flowcharts showing a routine for computing the purge rate, which is executed in step 210 of FIG. 10. First, in step 220 of FIG. 11, the ECU 31 judges whether now is the time to compute the duty ratio DPG. If now is not the time, the ECU 31 suspends the purge rate computation routine. If now is the time to compute the duty ratio DPG, the ECU 31 proceeds to step 222. In step 222, the ECU 31 judges whether a purge condition 1 is satisfied. For example, the ECU 31 judges whether the warming of the engine 8 is completed. If the purge condition 1 is not satisfied, the ECU 31 proceeds to step 242 and executes an initializing process. The ECU 31 then proceeds to step 244. In step 244, the ECU 31 sets the duty ratio DPG and the purge rate PGR to zero and suspends the purge rate computation routine. If the purge condition 1 is satisfied in step 222, the ECU 31 proceeds to step 224 and judges whether a condition 2 is satisfied. For example, the ECU 31 judges that the purge condition 2 is satisfied when the air-fuel ratio is being feedback controlled and fuel is being supplied. If the purge condition 2 is not satisfied, the ECU 31 proceeds to step 244. If the purge condition 2 is satisfied, the ECU 31 proceeds to step 226.

In step 226, the ECU 31 computes a full open purge rate PG100, which is the ratio of a full open purge flow rate KPQ to an intake air amount Ga. The full open purge flow rate KPQ represents the purge flow rate when the purge control valve 22 is fully opened, and the intake air amount Ga is detected by the intake air amount sensor 27 (see FIG. 1). The full open purge rate PG100 is, for example, a function of the engine load Q/N (the intake air amount Ga/the engine speed NE) and the engine speed NE, and is previously stored in the ROM 33 in a form of a map.

As the engine load Q/N decreases, the full open purge flow rate KPQ increases relative to the intake air amount Ga. The full open purge rate PG100 is also increased as the engine load Q/N decreases. As the engine speed NE decreases, the full open purge flow rate KPQ increases relative to the intake air amount Ga. Thus, the full open purge rate PG100 increases as the engine speed NE decreases.

In step 228, the ECU 31 judges whether the feedback correction factor FAF is in the range between an upper limit value KFAF15 (KFAF15=1.15) and a lower limit value KFAF85 (KFAF 85=0.85). If an inequality KFAF15>FAF>KFAF85 is satisfied, that is, if the air-fuel ratio is being feedback controlled to the stoichiometric air-fuel ratio, the ECU 31 proceeds to step 230. In step 230, the ECU 31 adds a fixed value KPGRu to the purge rate PGR to obtain a target purge rate tPGR (tPGR←PGR+KPGRu). That is, if the inequality KFAF15>FAF>KFAF85 is satisfied, the target purge rate tPGR is gradually increased. An upper limit value P (for example, 6%) is set for the target purge rate tPGR. Therefore, the target purge rate tPGR is increased up to the upper limit value P. The ECU 31 then proceeds to step 234 of FIG. 12.

If the inequality FAF≧KFAF15 or the inequality FAF≦KFAF85 is satisfied in step 228 of FIG. 11, the ECU 31 proceeds to step 232. In step 232, the ECU 31 subtracts a fixed value KPGRd from the purge rate PGR to obtain the target purge rate tPGR (tPGR←PGR−KPGRd). That is, when the air-fuel ratio cannot be maintained at the stoichiometric air-fuel ratio because of the influence of purging of fuel vapor, the target purge rate tPGR is decreased. A lower limit value T (T=0%) is set for the target purge rate tPGR. The ECU 31 then proceeds to step 234 of FIG. 12.

In step 234 of FIG. 12, the ECU 31 divides the target purge rate tPGR by the full open purge rate PG100 to obtain the duty ratio DPG of the driving pulse signal sent to the purge control valve 22 (DPG←(tPGR/PG100)·100). Thus, the duty ratio DPG, or the opening degree of the purge control valve 22, is controlled in accordance with the ratio of the target purge rate tPGR to the full open purge rate PG100. As a result, the actual purge rate is maintained at the target purge rate under any running condition of the engine 8 regardless of the value of the target purge rate tPGR.

For example, if the target purge rate tPGR is 2% and the full open purge rate PG100 is 10% under the current running state, the duty ratio DPG of the driving pulse is 20%, and the actual purge rate is 2%. If the running state is changed and the full open purge rate PG100 is changed to 5%, the driving pulse duty ratio DPG becomes 40%. At this time, the actual purge rate becomes 2%. That is, if the target purge rate tPGR is 2%, the actual purge rate is maintained to 2% regardless of the running state of the engine 8. If the target purge rate tPGR is changed to 4%, the actual purge rate is maintained at 4% regardless of the running state of the engine 8.

In step 236, the ECU 31 multiplies the full open purge rate PG100 by the duty ratio DPG to obtain a theoretical purge rate PGR (PGR←PGR100·(DPG/100)). Since the duty ratio DPG is represented by (tPGR/PG100)·100, the computed duty ratio DPG becomes greater than 100% if the target purge rate tPGR is greater than the full open purge rate PG100. However, the duty ratio DPG cannot be over 100%, and if the computed duty ratio DPG is greater than 100%, the duty ratio DPG is set to 100%. Therefore, the theoretical purge rate PGR can be less than the target purge rate tPGR.

In step 238, the ECU 31 sets the duty ratio DPG to DPGO, and sets the purge rate PGR to PGRO. Thereafter, in step 240, the ECU 31 increments a purging time count value CPGR by one. The count value CPGR represents the time elapsed since the purging is started. The ECU 31 then terminates the purge rate computation routine.

Figure 13:
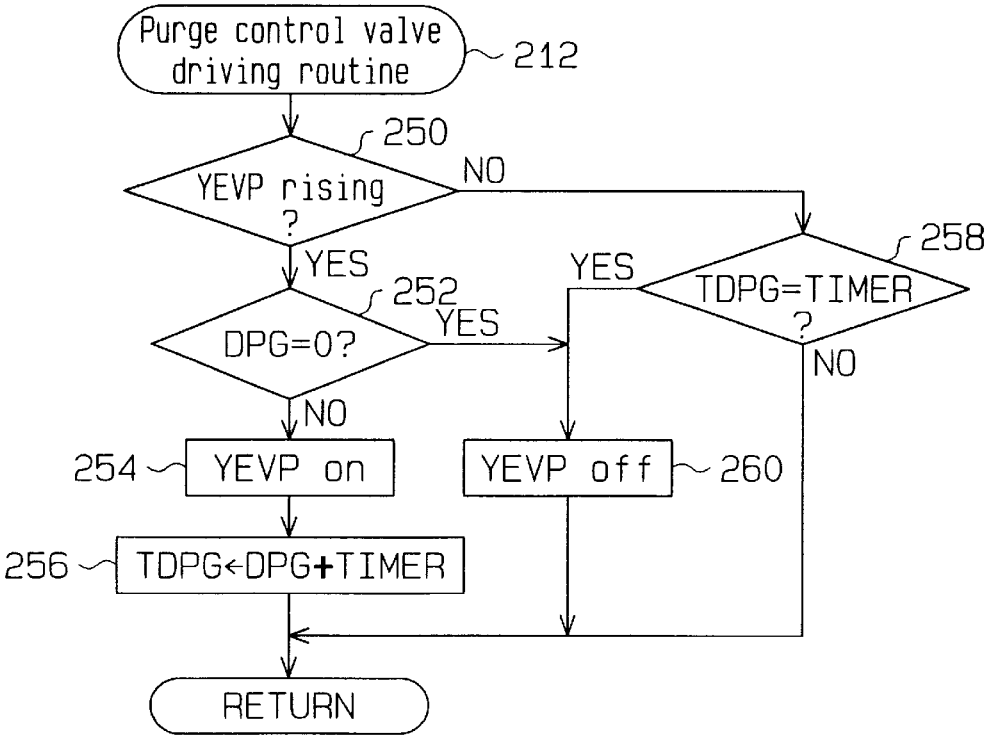
FIG. 13 is a flowchart showing a routine for actuating the purge control valve shown in FIG. 1.

FIG. 13 shows a flowchart of the procedure for driving the purge control valve 22 executed in step 212 of FIG. 10. First in step 250 of FIG. 13, the ECU 31 judges whether a driving pulse signal YEVP sent to the purge control valve 22 is currently rising. If the driving pulse signal YEVP is rising, the ECU 31 proceeds to step 252, and judges whether the duty ratio DPG is zero. If the DPG is zero (DPG=0), the ECU 31 proceeds to step 260 and turns the driving pulse signal YEVP off. If the DPG is not zero, the ECU 31 proceeds to step 254 turns the driving pulse signal YEVP on. In step 256, the ECU 31 adds the duty ratio DPG to the present time TIMER to obtain an off time TDPG of the driving pulse signal YEVP (TDPG←DPG+TIMER). The ECU 31 then terminates the purge control valve driving routine.

If the ECU 31 judges that the driving pulse signal YEVP is not rising in step in step 250, the ECU 31 proceeds to step 258. In step 258, the ECU 31 judges whether the present time TIMER is the off time TDPG of the driving pulse signal YEVP. If the present time TIMER is the off time TDPG, the ECU 31 proceeds to step 260 and turns off the driving pulse signal YEVP and terminates the purge control valve driving routine. If the present time TIMER is not the off time TDPG, the ECU 31 terminates the purge control valve driving routine.

Figure 14:
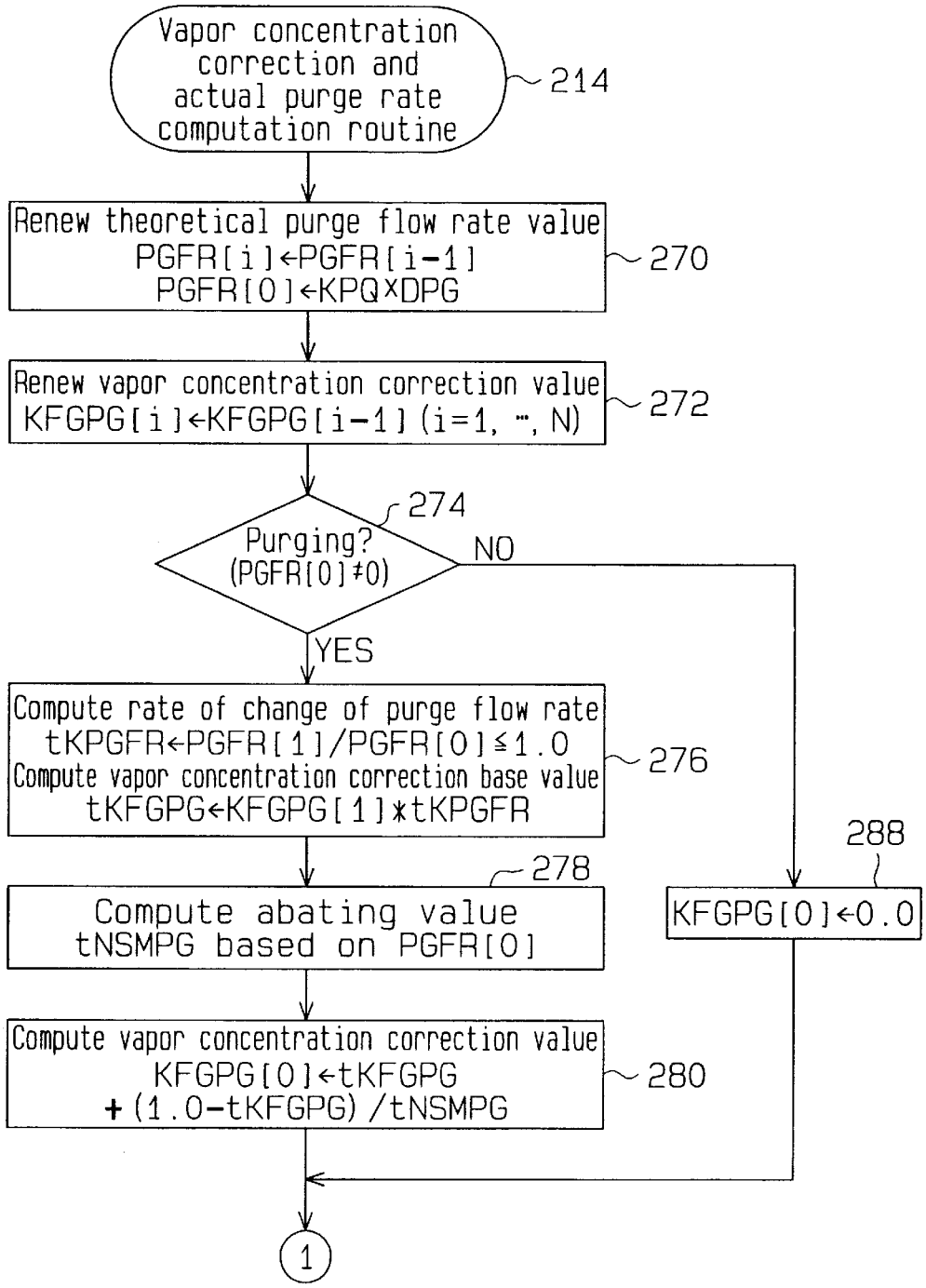
FIG. 14 is a flowchart showing a first part of a routine for correcting the vapor concentration and computing the actual purge rate shown in FIG. 10.
Figure 15:
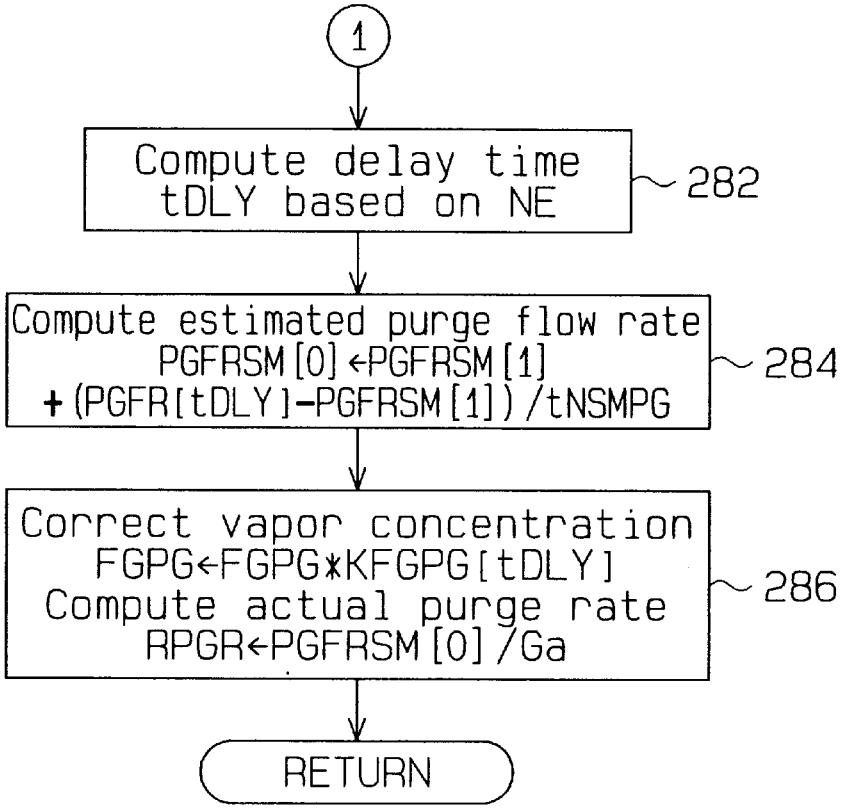
FIG. 15 is a flowchart showing a second part of the routine shown in FIG. 14.

FIGS. 14 and 15 are flowcharts of a routine for correcting the vapor concentration and a routine for computing the actual purge rate. These routines are executed in step 214 of FIG. 10.

Figure 16:
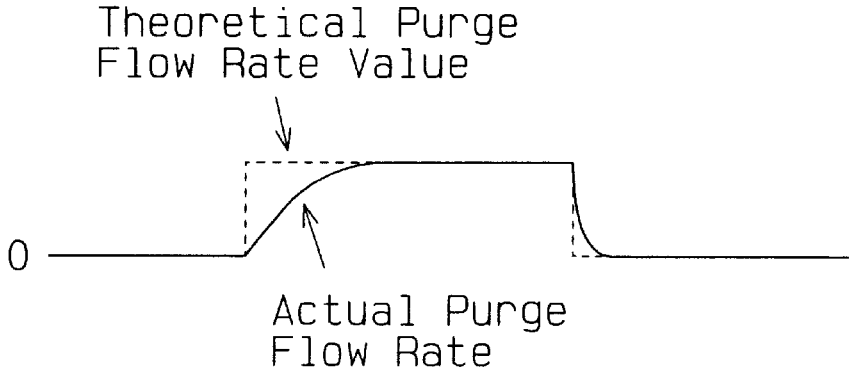
FIG. 16 is a time chart for explaining changes in the actual purge flow arte.

The routine for correcting the vapor concentration and the routine for computing the actual purge rate are executed for the following reasons. If the duty ratio DPG is significantly increased as shown in FIG. 16 and the opening degree of the purge control valve 22 is abruptly increased, the theoretical value of the purge flow rate is abruptly increased. However, due to the distance between the purge control valve 22 and the combustion chambers, the actual purge flow rate is increased to reach the theoretical value of the purge flow rate after a delay. The response delay of the actual purge flow rate occurs when the theoretical value of the purge flow rate corresponding to the opening degree of the purge control valve 22 is increased and is decreased. When the theoretical value of the purge flow rate is increased, the actual purge rate is less than the theoretical purge rate, which corresponds to the theoretical value of the purge flow rate. Therefore, if the fuel injection amount is computed based on the theoretical purge rate, the fuel injection amount would be insufficient and the air-fuel mixture would be lean. When the theoretical value of the purge flow rate is decreased, the actual purge rate becomes greater than the theoretical purge rate, which corresponds to the theoretical value of the purge flow rate. Therefore, if the fuel injection amount is computed based on the theoretical purge rate, the fuel injection amount would be excessive and the air-fuel mixture would be rich.

Further, when the purge flow rate is abruptly increased, the fuel vapor cannot separate from the canister 14 quickly enough, which lowers the concentration of the fuel vapor in the purge gas. Therefore, if the fuel injection amount is computed based on the purge concentration learning value as in the normal state, the fuel injection amount would be insufficient and the air-fuel mixture is lean. To prevent such deterioration of accuracy in the air-fuel ratio control, the purge concentration correction routine and the actual purge rate computation routine are executed in this embodiment.

Figure 21:
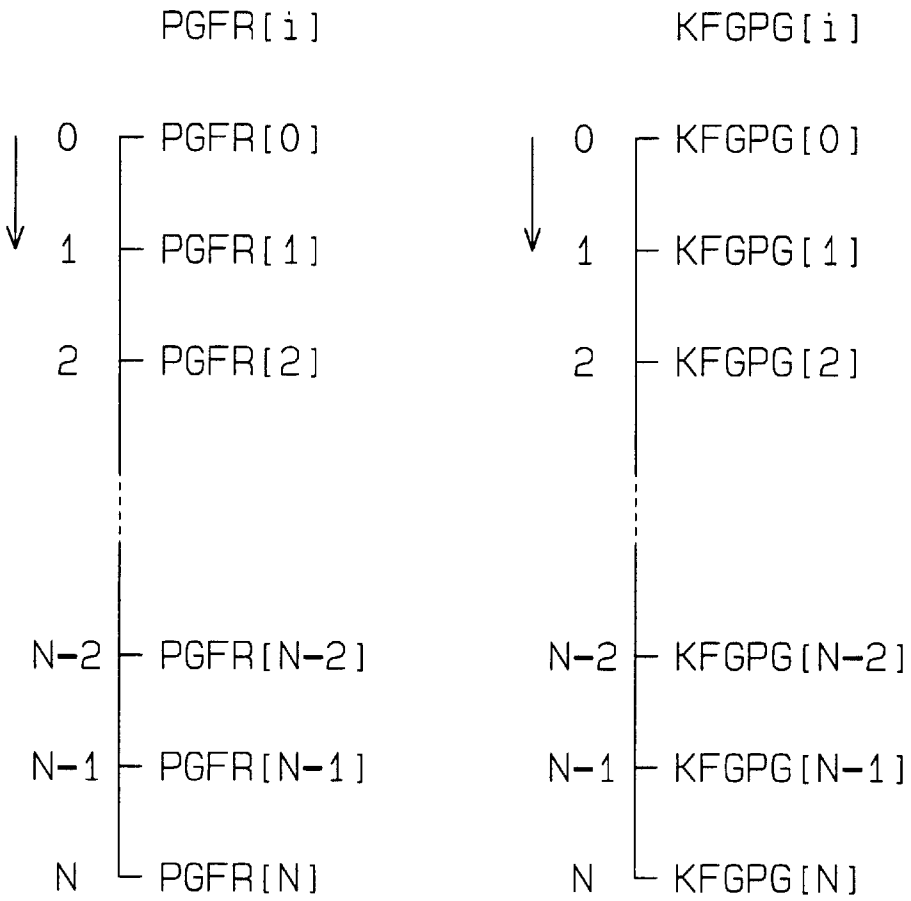
FIG. 21 is a diagram showing the theoretical values of the purge flow rate and the corrected values of the vapor concentration stored in the ECU in time sequence.

Several theoretical purge flow rate value PGFR[i−1] are stored in the RAM 34 in time sequence. In step 270 of FIG. 14, the ECU 31 sets each theoretical purge flow rate value PGFR[i−1] as a one-cycle old theoretical purge flow rate value PGFR[i], thereby renewing the theoretical purge flow rate values PGFR[i] in time sequence as shown in FIG. 21. "i" represents a natural number in a group from one to a predetermined number N. The greater the value of "i" is, the older the theoretical purge flow rate value PGFR[i] is. At the moment, the latest theoretical purge flow rate value is represented by PGFR[1−1], or PGFR[0]. In step 270, for example, the latest theoretical purge flow rate value PGFR [0] is set as a one-cycle old theoretical purge flow rate value PGFR[1].

Figure 17:
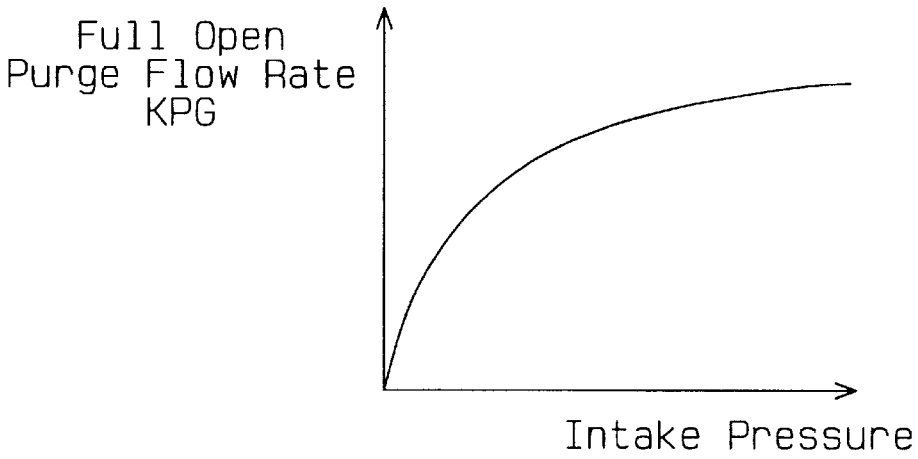
FIG. 17 is a map showing the relationship between the intake negative pressure and the full open purge flow rate.

Also, in step 270, the ECU 31 multiplies the full open purge flow rate KPQ, which is computed based on the pressure (vacuum) in the intake passage 10 detected by an intake pressure sensor (not shown) by referring to a map of FIG. 17, by the duty ratio DPG, thereby computing the theoretical purge flow rate value PGFR[0] of the current cycle. The map of FIG. 17 represents the relationship between the intake vacuum and the full open purge flow rate KPQ and is previously stored in the ROM 33 of the ECU 31. As shown in FIG. 17, the full open purge flow rate KPQ increases as the intake vacuum increases.

Several vapor concentration correction values KFGPG[i−1] are stored in the RAM 34 in time sequence. In step 272 of FIG. 14, the ECU 31 sets each vapor concentration correction value KFGPG[i−1] as a one-cycle old vapor concentration correction value KFGPG[i], thereby renewing the vapor concentration correction values KFGPG[i] in time sequence as shown in FIG. 21.

In step 274, the ECU 31 judges whether purging is currently performed based on whether the current theoretical purge flow rate value PGFR[0] is zero. If the current theoretical purge flow rate value PGFR[0] is zero, the ECU 31 judges that purging is not currently performed. When judging that purging is currently performed, the ECU 31 proceeds to step 276. When judging that purging is not currently performed, the ECU 31 proceeds to step 288. In step 288, the ECU 31 sets the vapor concentration correction value KFGPG[0] of the current cycle to 0.0. The ECU 31 then proceeds to step 282 of FIG. 15.

In step 276 of FIG. 14, ECU 31 divides the one-cycle old theoretical purge flow rate value PGFR[1] by the current theoretical purge flow rate value PGFR[0], thereby obtaining a purge flow rate change rate tKPGFR (tKPGFR←PGFR[1]/PGFR[0]). An upper limit value (for example, 1.0) is set for the purge flow rate change rate tKPGFR. Therefore, the purge flow rate change rate tKPGFR is increased up to the upper limit value. In step 276, the ECU 31 multiplies the one-cycle old vapor concentration correction value KFGPG[1] by the purge flow rate change rate tKPGFR, thereby obtaining a vapor concentration correction base value tKFGPG (tKFGPG←KFGPG[1] *tKPGFR).

Figure 18:
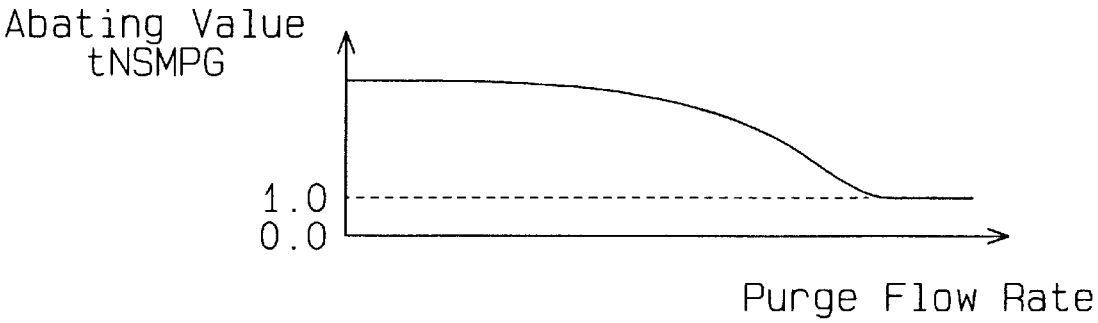
FIG. 18 is a map showing the relationship between the purge flow rate and an abating value.

In step 278, the ECU 31 computes an abating value tNSMPG based on the current theoretical purge flow rate value PGFR[0] by referring to the map of FIG. 18. FIG. 18 shows the relationship between the theoretical purge flow rate value PGFR[0] and the abating value tNSMPG. The map of FIG. 18 is previously stored in the ROM 33. As shown in FIG. 18, the abating value tNSMPG is set to 1.0 when the theoretical purge flow rate value PGFR[0] is greater than a predetermined value. When the theoretical purge flow rate value PGFR[0] is less than the predetermined value, the abating value tNSMPG is set to a value that is greater than 1.0. This because when the theoretical purge flow rate value PGFR[0] is greater, the separation delay of vapor from the canister 14 is lessened, and when the theoretical purge flow rate value PGFR[0] is smaller, separation delay of vapor from the canister 14 is increased.

In step 280, the ECU 31 computes a vapor concentration correction value KFGPG[0] based on the following equation 4.

Thereafter, the ECU 31 proceeds to step 282.

$$KFGPG[0] \leftarrow tKFGPG + (1.0 - tKFGPG)/tNSMPG \qquad \text{Equation 4}$$

Figure 19:
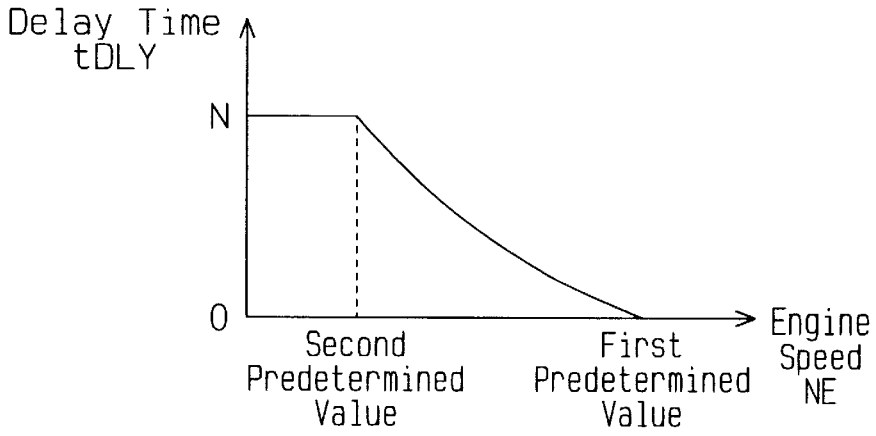
FIG. 19 is a map for computing a delay time.

In step 282, the ECU 31 computes a delay time tDLY based on the engine speed NE by referring to the map of FIG. 19. The delay time tDLY represents ordinal numbers (0 to N) in time sequence shown in FIG. 21. The map of FIG. 19 shows the relationship between the engine speed NE and the delay time tDLY. The map of FIG. 19 is previously stored in the ROM 33. As shown in FIG. 19, the delay time tDLY is set to zero when the engine speed NE is higher than a first predetermined value. The delay time tDLY is set to N when the engine speed NE is lower than a second predetermined value. In the range between the two predetermined values, the delay time tDLY decreases as the engine speed NE increases. The delay time tDLY represents the degree of delay in the introduction of the purge gas to the combustion chambers due to the engine speed NE. In other words, the delay time tDLY represents a response delay of the actual purge flow rate PGFRSM in relation to the theoretical purge flow rate value PGFR. Then, the ECU 31 proceeds to step 284.

In step 284, the ECU 31 computes the actual purge flow rate PGFRSM based on the following equation 5 by taking the response delay in relation to the theoretical purge flow rate value PGFR into consideration. Thereafter, the ECU 31 proceeds to step 286.

$$PGFRSM[0] \leftarrow PGFRSM[1] + (PGFR[tDLY] - PGFRSM[1])/tNSMPG \qquad \text{Equation 5}$$

In the equation 5, PGFRSM[0] represents the actual purge flow rate computed in the current cycle of the routine, or an estimated current purge flow rate value, and PGFRSM[1] represents the current purge flow rate computed in the last cycle of the routine, or an estimated purge flow rate of the last cycle. As shown in the equation 5, the actual purge flow rate value PGFRSM[0] is computed by using selected ones of the theoretical purge flow rate values PGFR in time sequence in FIG. 21 that have the ordinal numbers (0 to N), which corresponds to the delay time tDLY. That is, when the engine speed NE is high, the intake delay of purge gas into the combustion chambers is reduced, and when the engine speed NE is low, the delay of purge gas into the combustion chambers is increased. Therefore, when the engine speed NE is high, the delay time tDLY is decreased, and a relatively new theoretical purge flow rate value PGFR is used for computing the actual purge flow rate PGFRSM[0]. When the engine speed NE is low, the delay time tDLY is increased, and a relatively old theoretical purge flow rate value PGFR is used for computing the actual purge flow rate value PGFRSM[0]. As a result, the response delay of the actual purge flow rate PGFRSM in relation to the theoretical purge flow rate value PGFR is appropriately compensated in accordance with the engine speed NE, and the actual purge flow rate PGFRSM[0] at present is accurately computed.

In step 286, the ECU 31 multiplies the vapor concentration value FGPG (vapor concentration learning value), which is computed in the step 186 of FIG. 8, by the vapor concentration correction value KFGPG[tDLY] to obtain a corrected vapor concentration value FGPG (FGPG←FGPG*KFGPG[tDLY]). In computation of the corrected vapor concentration value FGPG, one of the vapor concentration correction values KFGPG of an ordinal number (0 to N) corresponding to the delay time tDLY. That is, when the engine speed NE is high and the delay in intake of the purge gas into the combustion chambers is reduced, the delay time tDLY is reduced, and a relatively new vapor concentration correction value KFGPG is used for computing the corrected vapor concentration value FGPG. When the engine speed NE is low and the delay in intake of purge gas into the combustion chambers, the delay time tDLY is increased, and a relatively old vapor concentration correction value KFGPG is used for computing the corrected vapor concentration value FGPG. As a result, the actual vapor concentration value FGPG is accurately computed.

Also, in step 286, the ECU 31 divides the actual purge flow rate PGFRSM[0] (estimated purge flow rate value) computed in step 284 by the intake air amount Ga to compute the actual purge rate RPGR corresponding to the actual purge flow rate PGFRSM[0] (RPGR←PGFRSM/Ga).

Based on the corrected vapor concentration value FGPG and the actual purge rate RPGR computed in step 286, th ECU 31 computes the purge A/F correction factor FPG in step 204 of FIG. 9 and computes the fuel injection time TAU in step 206.

Figure 20:
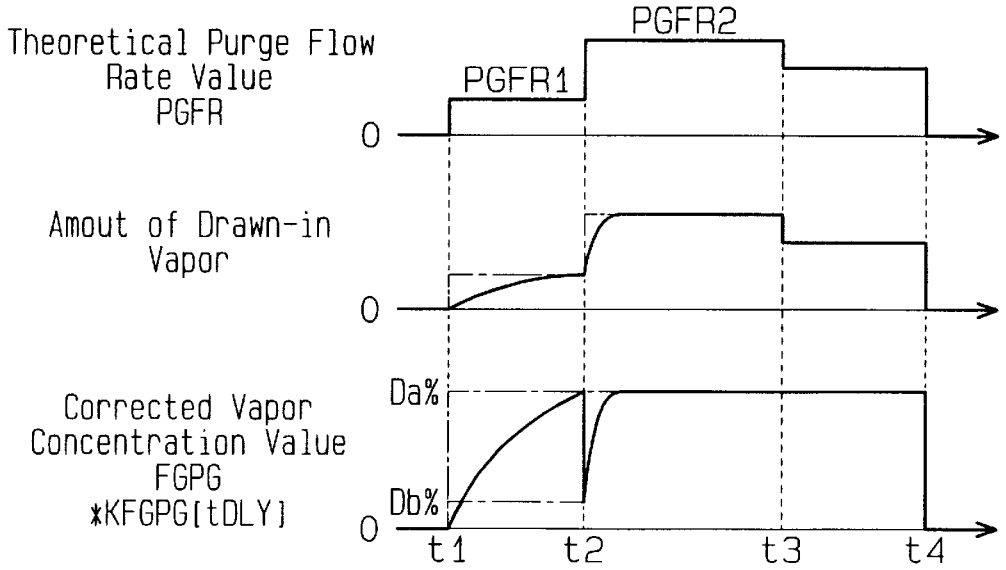
FIG. 20 is a time chart showing changes in the theoretical value of the purge flow rate, the amount of fuel vapor drawn into the combustion chamber, a corrected value of the vapor concentration.

FIG. 20 is a time chart showing an example of changes in the theoretical purge flow rate value PGFR, which corresponds to the opening degree of the purge control valve 22, the amount of fuel vapor drawn into the combustion chamber (drawn-in vapor amount), and the corrected vapor concentration value FGPG (FGPG←FGPG*KFGPG[tDLY]). The drawn-in vapor amount is computed by multiplying the actual purge flow rate PGFRSM with the corrected vapor concentration value FGPG. To facilitate the understanding, the vapor concentration learning value FGPG is assumed to be constant at a value Da %.

When the opening degree of the purge control value 22 is changed or the intake negative pressure in the intake passage 10 is changed at times t1, t2, t3, t4, the theoretical purge flow rate value PGFR is abruptly changed. However, the actual purge flow rate PGFRSM is changed after a delay. When the theoretical purge flow rate value PGFR is abruptly increased, a separation delay of the fuel vapor occurs in the canister 14. Therefore, at the times t1, t2, when the theoretical purge flow rate value PGFR is suddenly increased, and in predetermined periods subsequent to the times t1, t2, the corrected vapor concentration value FGPG is computed by taking into consideration of changes in the actual purge flow rate PGFRSM and the separation delay of the fuel vapor. In the period from the time t1 to the time t2, the theoretical purge flow rate value PGFR is a relatively small value PGFR1. Thus, the corrected vapor concentration value FGPG is gradually changed from 0% to Da % over the relatively long period from the time t1 to the time t2.

When the theoretical purge flow rate value PGFR is abruptly changed from the value PGFR1 to a value PGFR2 at the time t2, the corrected vapor concentration value FGPG abruptly drops to a value Db %, which is less than the value Da %. As a result, the drawn-in vapor amount computed at the time t2 is scarcely changed from the next previous value. In the period from the time t2 to the time t3, the theoretical purge flow rate value PGFR is the relatively great value PGFR2. Thus, the corrected vapor concentration value FGPG is relatively quickly changed from the value Db % to the value Da % immediately after the time t2.

When the theoretical purge flow rate PGFR is decreased, no separation delay of eh fuel vapor occurs in the canister 14. Therefore, when the theoretical purge flow rate value PGFR abruptly drops at the time t4, the corrected vapor concentration FGPG is maintained at the value Da %.

The above embodiment has the following advantages.

In this embodiment, the vapor concentration correction base value tKFGPG is computed based on the rate of change of the theoretical purge flow rate value PGFR. The vapor concentration correction base value tKFGPG is adjusted by using the abating value tNSMPG, which is determined according to the theoretical purge flow rate value PGFR, to compute the vapor concentration correction value KFGPG. The delay time tDLY, which reflects the response delay of the actual purge flow rate PGFRSM in relation to the theoretical purge flow rate value PGFR, is computed based on the engine speed NE.

Several theoretical purge flow rate values PGFR are stored in time sequence. The actual purge flow rate PGFRSM is estimated one of the stored theoretical purge flow rate value PGFR that corresponds to the delay time tDLY. Several vapor concentration correction values KFGPG are stored in time sequence. The vapor concentration learning value FGPG is corrected based on one of the stored vapor concentration correction values KFGPG that corresponds to the delay time tDLY. In other words, the theoretical purge flow rate value PGFR, which is used for estimating the actual purge flow rate PGFRSM, is determined based on the difference between the time at which the flow rate of purge gas is theoretically computed based on the opening degree of the purge control valve 22 and the time at which the purge gas having the computed theoretical flow rate is actually drawn into the combustion chamber. At the same time, the vapor concentration correction value KFGPG used for correcting the vapor concentration learning value FGPG is determined. The purge A/F correction factor FPG, which reflects the amount of fuel vapor that enters the combustion chamber at the moment, is computed based on the actual purge rate RPGR, which is computed based on the estimated actual purge flow rate PGFRSM, and the corrected vapor concentration value FGPG. The purge A/F correction factor FPG is used for computing the fuel injection time TAU, which corresponds to the target fuel injection amount. Therefore, even if the purge flow rate is abruptly increased, the purge A/F correction factor FPG is properly computed, and the fuel injection amount is prevented from being insufficient, which improves the accuracy of the air-fuel ratio control of the engine 8.

After the theoretical purge flow rate value PGFR is abruptly changed, the vapor concentration correction value KFGPG, which is computed in the above described manner, gradually converges on one as the actual purge flow rate PGFRSM gradually converges. That is, after the theoretical purge flow rate PGFR is abruptly changed, the amount of correction of the vapor concentration value FGPG approaches zero as time elapses. Accordingly, after the purge flow rate is abruptly increased, changes in the concentration of the fuel vapor in the purge gas until the separation state of the fuel vapor in the canister 14 becomes constant as time elapses are accurately reflected on the computation of the fuel injection amount. This prevents the fuel injection amount from being insufficient and improves the accuracy of the air-fuel ratio control.

The abating value tNSMP used for obtaining the vapor concentration correction value KFGPG is computed based on the purge flow rate. When the purge flow rate is abruptly increased, a delay of separation of fuel vapor from the canister 14 occurs. If the purge flow rate is great, the delay of separation of the fuel vapor is reduced, the vapor concentration quickly approaches a certain value. If the purge flow rate is small, the delay of separation of the fuel vapor is increased, and the vapor concentration slowly approaches the certain value. Therefore, the abating value tNSMPG is set to 1.0 when the purge flow rate is great, and is set to a value greater than 1.0 when the purge flow rate is small. As a result, when the purge concentration correction value KFGPG is computed, the vapor concentration is properly reflected, which improves the accuracy of the air-fuel ratio control.

It should be apparent to those skilled in the art that the present invention may be embodied in many other specific forms without departing from the spirit or scope of the invention. Particularly, it should be understood that the invention may be embodied in the following forms.

In the illustrated embodiment, the abating value tNSMPG, which is used when the vapor concentration correction value KFGPG is computed, is computed based on the purge flow rate by referring to the map of FIG. 18. However, the abating value tNSMPG may be computed by performing a predetermined operation based on the purge flow rate.

In the illustrated embodiment, the delay time tDLY is computed based on the engine speed NE by referring to the map of FIG. 19. However, the delay time tDLY may be computed by performing a predetermined operation based on the engine speed NE.

Therefore, the present examples and embodiments are to be considered as illustrative and not restrictive and the invention is not to be limited to the details given herein, but may be modified within the scope and equivalence of the appended claims.

What is claimed is:

1. An apparatus for controlling the air-fuel ratio of air-fuel mixture drawn into a combustion chamber of an engine, wherein an intake passage of the engine is connected to a canister by a purge line, wherein the canister adsorbs fuel vapor generated in the fuel tank and permits the adsorbed fuel vapor to be separated, wherein gas containing fuel vapor is purged as purge gas from the canister to the intake passage through the purge line, the apparatus comprising:

a purge controlling device for adjusting purge flow rate, which is the flow rate of the purge gas flowing through the purge line;

a sensor for detecting the air-fuel ratio of the air-fuel mixture;

a computer for setting the amount of fuel supplied to the combustion chamber such that the detected air-fuel seeks a target air-fuel ratio;

wherein the computer computes the purge flow rate based on the state of the purge controlling device, and computes vapor concentration, which is the concentration of the fuel vapor contained in the purge gas, based on the difference between the detected air-fuel ratio and the target air-fuel ratio;

wherein, in accordance with changes of the computed purge flow rate, the computer obtains a concentration correction value for correcting the computed vapor concentration;

wherein, by taking into consideration of the difference between the time at which the purge flow rate is computed and the time at which purge gas having the computed flow rate is drawn into the combustion chamber, the computer corrects the computed vapor concentration by using the concentration correction value; and wherein the computer sets the fuel supply amount in accordance with the computed purge flow rate and the corrected vapor concentration.

2. The apparatus according to claim 1, wherein the computer computes a delay time, which reflects the time difference, in accordance with the speed of the engine.

3. The apparatus according to claim 2, wherein the computed delay time decreases as the engine speed increases.

4. The apparatus according to claim 2, wherein the computer stores a plurality of time-sequential values of the concentration correction value, and wherein the computer selects one of the stored time-sequential concentration correction values that corresponds to the computed delay time and uses the selected concentration correction value for correcting the computed vapor concentration.

5. The apparatus according to claim 4, wherein the computer selects an older one of the concentration correction values for a greater value of the computed delay time.

6. The apparatus according to claim 2, wherein the computer stores a plurality of time-sequential values of the computed purge flow rate, and wherein the computer selects one of the stored time-sequential purge flow rates that corresponds to the computed delay time as an actual purge flow rate and uses the actual purge flow rate for setting the fuel supply amount.

7. The apparatus according to claim 6, wherein the computer selects an older one of the computed purge flow rates for a greater value of the computed delay time.

8. The apparatus according to claim 1, wherein, the computer sets the concentration correction value such that the correction amount of the computed vapor concentration, which is obtained by using the concentration correction value, gradually approaches zero as time elapses after the computed purge flow rate is changed.

9. The apparatus according to claim 8, wherein the computer sets the concentration correction value such that the degree of change of the correction amount of the computed vapor concentration, which is obtained by using the concentration correction value, changes according to the computed purge flow rate.

10. The apparatus according to claim 1, wherein the computer computes a feedback correction value based on the difference between the detected air-fuel ratio and the target air-fuel ratio, wherein the feedback correction value is used for feedback correcting the fuel supply amount, and wherein the computer computes the vapor concentration according to the feedback correction value.

11. An apparatus for controlling the air-fuel ratio of air-fuel mixture drawn into a combustion chamber of an engine, wherein an intake passage of the engine is connected to a canister by a purge line, wherein the canister adsorbs fuel vapor generated in the fuel tank and permits the adsorbed fuel vapor to be separated, wherein gas containing fuel vapor is purged as purge gas from the canister to the intake passage through the purge line, the apparatus comprising:

a purge control valve for adjusting purge flow rate, which is the flow rate of the purge gas flowing through the purge line;

a sensor for detecting the air-fuel ratio of the air-fuel mixture;

a computer for setting the amount of fuel supplied to the combustion chamber such that the detected air-fuel seeks a target air-fuel ratio;

wherein the computer computes the purge flow rate based on the opening degree of the purge control valve, and computes vapor concentration, which is the concentration of the fuel vapor contained in the purge gas, based on the difference between the detected air-fuel ratio and the target air-fuel ratio;

wherein, in accordance with the rate of change of the computed purge flow rate, the computer obtains a concentration correction value for correcting the computed vapor concentration, and stores a plurality of time-sequential values of the obtained concentration correction value;

wherein the computer computes a delay time according to the speed of the engine, the delay time reflecting the difference between the time at which the purge flow rate is computed and the time at which purge gas having the computed flow rate is drawn into the combustion chamber;

wherein the computer selects one of the stored time-sequential concentration correction values that corresponds to the computed delay time and uses the selected concentration correction value for correcting the computed vapor concentration; and wherein the computer sets the fuel supply amount in accordance with the computed purge flow rate and the corrected purge concentration.

12. The apparatus according to claim 11, wherein the computed delay time decreases as the engine speed increases.

13. The apparatus according to claim 11, wherein the computer selects an older one of the concentration correction values for a greater value of the computed delay time.

14. The apparatus according to claim 11, wherein the computer stores a plurality of time-sequential values of the computed purge flow rate, and wherein the computer selects one of the stored time-sequential purge flow rates that corresponds to the computed delay time as an actual purge flow rate and uses the actual purge flow rate for setting the fuel supply amount.

15. The apparatus according to claim 14, wherein the computer selects an older one of the computed purge flow rates for a greater value of the computed delay time.

16. The apparatus according to claim 11, wherein the computer sets the concentration correction value such that the correction amount of the computed vapor concentration, which is obtained by using the concentration correction value, gradually approaches zero as time elapses after the computed purge flow rate is changed.

17. The apparatus according to claim 16, wherein the computer sets the concentration correction value such that the degree of change of the correction amount of the computed vapor concentration, which is obtained by using the concentration correction value, changes according to the computed purge flow rate.

18. The apparatus according to claim 11, wherein the computer computes a feedback correction value based on the difference between the detected air-fuel ratio and the target air-fuel ratio, wherein the feedback correction value is used for feedback correcting the fuel supply amount, and wherein the computer computes the vapor concentration according to the feedback correction value.

19. A method for controlling the air-fuel ratio of air-fuel mixture drawn into a combustion chamber of an engine, wherein an intake passage of the engine is connected to a canister by a purge line, wherein the canister adsorbs fuel vapor generated in the fuel tank and permits the adsorbed fuel vapor to be separated, wherein gas containing fuel vapor is purged as purge gas from the canister to the intake passage through the purge line, the method comprising:

adjusting purge flow rate, which is the flow rate of the purge gas flowing through the purge line, with a purge controlling device;

detecting the air-fuel ratio of the air-fuel mixture;

computing the purge flow rate based on the state of the purge controlling device;

computing vapor concentration, which is the concentration of the fuel vapor contained in the purge gas, based on the difference between the detected air-fuel ratio and the target air-fuel ratio;

obtaining a concentration correction value in accordance with changes of the computed purge flow rate;

correcting the computed vapor concentration by using the concentration correction value and by taking into consideration of the difference between the time at which the purge flow rate is computed and the time at which purge gas having the computed flow rate is drawn into the combustion chamber; and setting the amount of fuel supplied to the combustion chamber in accordance with the computed purge flow rate and the corrected vapor concentration such that the detected air-fuel ratio seeks a target air-fuel ratio.

* * * * *